US011933575B2

(12) United States Patent
Song

(10) Patent No.: US 11,933,575 B2
(45) Date of Patent: Mar. 19, 2024

(54) SHOOTING GAME SYSTEM USING AIRSOFT GUN, METHOD FOR CONTROLLING SAFE DISTANCE, AND METHOD FOR CONTROLLING AUTO-TRACER

(71) Applicant: YOUNGBAE CO., LTD, Seoul (KR)

(72) Inventor: Seung Won Song, Seoul (KR)

(73) Assignee: Youngbae Co., Ltd, Seoul (KR)

( * ) Notice: Subject to any disclaimer, the term of this patent is extended or adjusted under 35 U.S.C. 154(b) by 165 days.

(21) Appl. No.: 17/764,368

(22) PCT Filed: Feb. 18, 2021

(86) PCT No.: PCT/KR2021/002090

§ 371 (c)(1),
(2) Date: Mar. 28, 2022

(87) PCT Pub. No.: WO2021/167383

PCT Pub. Date: Aug. 26, 2021

(65) Prior Publication Data

US 2022/0333893 A1 Oct. 20, 2022

(30) Foreign Application Priority Data

Feb. 19, 2020 (KR) ..... 10-2020-0020672
Jul. 16, 2020 (KR) ..... 10-2020-0088471
Jul. 27, 2020 (KR) ..... 10-2020-0092819

(51) Int. Cl.
*F41B 11/723* (2013.01)
*F41B 11/56* (2013.01)
*F41B 11/62* (2013.01)

(52) U.S. Cl.
CPC ..... *F41B 11/56* (2013.01); *F41B 11/62* (2013.01); *F41B 11/723* (2013.01)

(58) Field of Classification Search
CPC ..... F41B 11/56; F41B 11/57; F41B 11/62; F41B 11/723; F41B 11/71; F42B 12/382
(Continued)

(56) References Cited

U.S. PATENT DOCUMENTS 4,429,612 A * 2/1984 Tidman ..... F41B 6/00 376/125
4,625,618 A * 12/1986 Howanick ..... F41B 6/006 89/8

(Continued)

FOREIGN PATENT DOCUMENTS

KR 10-2008-0113181 A 12/2008
KR 10-2012-0012352 A 2/2012

(Continued)

OTHER PUBLICATIONS

International Search Report and Written Opinion dated May 24, 2021 in International Application No. PCT/KR2021/002090. (English translation of ISR.).

(Continued)

*Primary Examiner* — Michael D David
(74) *Attorney, Agent, or Firm* — Knobbe, Martens, Olson & Bear, LLP

(57) ABSTRACT

This application relates to a shooting game system using an airsoft gun and an auto tracer control method. In one aspect, the system includes a main body including a muzzle through which a pellet moves, a light-emitting device providing light to the pellet so that the pellet is changed to a fluorescent color in a light-emitting region in the muzzle, and a sensor unit configured to detect pulling of a trigger provided on the main body and provide a firing detection signal. The system may also include a control board configured to control a supply unit to provide the pellet and the compressed gas to the main body in response to the firing detection signal and including an auto tracer controller configured to control the (Continued)

light-emitting device to emit light at a timing when the pellet passes through the light-emitting region in response to the firing detection signal.

14 Claims, 18 Drawing Sheets

(58) Field of Classification Search
USPC ..... 124/73, 74, 76, 71, 77, 51.1, 75, 69, 56, 124/3
See application file for complete search history.

(56) References Cited

U.S. PATENT DOCUMENTS 5,017,549 A * 5/1991 Robertson ..... F41B 6/00 89/8
5,762,058 A * 6/1998 Cheng ..... F41A 21/32 124/83
5,819,715 A * 10/1998 Haneda ..... F41B 4/00 124/6
5,947,738 A * 9/1999 Muehle ..... F41A 33/02 434/18
6,191,574 B1 * 2/2001 Dilger ..... F41B 5/14 250/215
6,247,995 B1 * 6/2001 Bryan ..... B05B 7/2472 435/189
6,807,959 B1 * 10/2004 Murdock ..... F41B 11/723 124/61
7,041,203 B2 * 5/2006 Sullivan ..... H01M 10/345 320/135
7,173,540 B2 * 2/2007 Daigle ..... F42B 12/36 102/209
7,900,619 B1 * 3/2011 Palmer ..... F42B 12/42 124/16
7,926,408 B1 * 4/2011 Kley ..... F42B 10/40 89/41.17
7,996,946 B1 * 8/2011 Riley ..... F28G 1/12 165/95
8,322,329 B1 * 12/2012 Sikes ..... F41B 11/723 124/73
10,415,925 B2 * 9/2019 Warren ..... F41A 13/02
11,662,187 B1 * 5/2023 Pineda ..... F41B 11/57 124/41.1
2001/0010221 A1 * 8/2001 Nishio ..... F41B 7/003 124/16
2003/0089361 A1 * 5/2003 Christensen ..... F41B 11/57 124/77
2005/0074726 A1 * 4/2005 Metcalfe ..... F41B 11/724 434/18
2006/0042616 A1 3/2006 Orr
2009/0127789 A1 * 5/2009 Andersen ..... F41J 5/24 124/56
2009/0253103 A1 * 10/2009 Hogan, Jr. ..... F41B 11/50 434/24
2012/0187249 A1 * 7/2012 Hunter ..... F42B 10/663 244/158.5
2013/0098344 A1 * 4/2013 Morris, II ..... F41B 5/1488 124/90
2014/0094231 A1 * 4/2014 Orton ..... F41B 11/00 463/2
2015/0175278 A1 * 6/2015 Hunter ..... B64G 5/00 244/158.5
2015/0354916 A1 * 12/2015 Polanich ..... F41B 7/003 124/25.6
2018/0098643 A1 * 4/2018 Martino ..... F42B 6/006
2022/0049932 A1 * 2/2022 Argyle ..... F41G 3/22
2023/0090270 A1 * 3/2023 Snook ..... G05B 19/416
2023/0175811 A1 * 6/2023 Song ..... F41G 1/06 124/80

FOREIGN PATENT DOCUMENTS

KR 10-2013-0068545 A 6/2013
KR 10-1440471 B1 9/2014
KR 10-2017-0102643 A 9/2017
KR 10-2018-0043130 A 4/2018
KR 10-2173265 B1 10/2020
KR 10-2173266 B1 10/2020
WO WO 2021/167181 A1 8/2021

OTHER PUBLICATIONS

Office Action dated Aug. 4, 2020 in Korean Application No. 10-2020-0088471.
Notice of Allowance dated Oct. 23, 2020 in Korean Application No. 10-2020-0088471.
Office Action dated Aug. 20, 2020 in Korean Application No. 10-2020-0092819.
Notice of Allowance dated Oct. 23, 2020 in Korean Application No. 10-2020-0092819.

* cited by examiner

FIG. 15B

| | AIR VALVE | FEEDER | FIRING DETECTION |
|---|---|---|---|
| DISTANCE O LIGHT ANGLE O | ACTIVATE | ACTIVATE | ACTIVATE |
| DISTANCE X LIGHT ANGLE X | INACTIVATE | INACTIVATE | INACTIVATE |

FIG. 15C

| | AIR VALVE | FEEDER | FIRING DETECTION |
|---|---|---|---|
| DISTANCE X LIGHT ANGLE O | INACTIVATE | INACTIVATE | ACTIVATE |
| DISTANCE O LIGHT ANGLE X | ACTIVATE | INACTIVATE | ACTIVATE |
| DISTANCE X LIGHT ANGLE X | ACTIVATE | ACTIVATE | INACTIVATE |

SHOOTING GAME SYSTEM USING AIRSOFT GUN, METHOD FOR CONTROLLING SAFE DISTANCE, AND METHOD FOR CONTROLLING AUTO-TRACER

The present application is a U.S. national phase application under 35 U.S.C. § 371 of International Application No. PCT/KR2021/002090, filed on Feb. 18, 2021, which claims the benefit of Korean Patent Applications Nos. 10-2020-0020672, 10-2020-0088471, and 10-2020-0092819 filed on Feb. 19, 2020, Jul. 16, 2020, and Jul. 27, 2020, respectively, in the Korean Intellectual Property Office, the entire disclosure of each of which is incorporated herein by reference.

TECHNICAL FIELD

The present disclosure relates to a shooting game system using an airsoft gun, and more particularly, to a shooting game system and an auto tracer control method for controlling a pellet to be fired by giving fluorescence to the pellet.

BACKGROUND ART

With the recent development of awareness of entertainment and leisure life along with the development of multimedia technology and computer programming technology, various types of games and game tools have been developed and used. Shooting games are very popular because they help relieve stress by providing tension, excitement, and refreshment, and shooting games using guns for shooting games are required to create more realistic situations.

However, when a shooting game played while directly firing pellets is performed, because it has a complex structure up to a process of physically directly firing the pellets, the risk of failure is increased, and it is necessary to solve safety problems caused by the firing of the pellets. In particular, the risk of failure is increased, due to an engine structure including a hammer, a sear, a firing pin knocker, and various springs for firing pellets.

Also, improving a user's satisfaction by maximizing the visual effect of a shooting game is a very important factor in a shooting game system. In particular, the visual effect optimized for the shooting game system in which real pellets are fired may be a main factor in improving product competitiveness.

DESCRIPTION OF EMBODIMENTS

Technical Problem

The present disclosure is designed to solve the above problems, and therefore the present disclosure is directed to providing a shooting game system using an airsoft gun and an auto tracer control method, which may maximize user satisfaction by providing a tracer function by giving fluorescent characteristics to pellets.

The present disclosure is also directed to providing a shooting game system and a safe distance control method, which may detect various risk factors and immediately control entry into a firing mode to ensure safety based on electric/electronic control.

Solution to Problem

A shooting game system according to an aspect of the present disclosure includes a main body including a muzzle through which a pellet moves, a light-emitting device being mounted in the main body and providing light to the pellet so that the pellet is changed to a fluorescent color in a light-emitting region in the muzzle, a sensor unit configured to detect pulling of a trigger provided on the main body and provide a firing detection signal, a supply unit configured to supply the pellet and compressed gas to the main body, and a control board configured to control the supply unit to provide the pellet and the compressed gas to the main body in response to the firing detection signal, wherein the control board includes an auto tracer controller configured to control the light-emitting device to emit light at a timing when the pellet passes through the light-emitting region in response to the firing detection signal.

Also, a shooting game system according to an aspect of the present disclosure includes a main body including a muzzle through which a pellet moves, a distance detection sensor for detecting a distance to a target being mounted on a side of the main body, a sensor unit configured to detect pulling of a trigger provided on the main body and provide a firing detection signal, a supply unit configured to supply the pellet and compressed gas to the main body, and a control board configured to control the supply unit to provide the pellet and the compressed gas to the main body in response to the firing detection signal, wherein the control board includes a firing controller configured to block firing of the pellet by controlling at least one of the sensor unit and the supply unit when the distance detected from the distance detection sensor is out of a certain set range.

Advantageous Effects of Disclosure

According to a shooting game system and an auto tracer control method according to an embodiment of the present disclosure, because a pellet may be fired without using an engine structure through a sensor unit capable of detecting pulling of a trigger and a control board capable of controlling a supply unit to supply a pellet and compressed gas in response to a signal of the sensor unit, the risk of failure of an airsoft gun may be reduced by not using the engine structure.

Also, according to a shooting game system and a safe distance control method according to an embodiment of the present disclosure, because a pellet may be fired without using an engine structure through a sensor unit capable of detecting pulling of a trigger and a control board capable of controlling a supply unit to supply a pellet and compressed gas, the risk of failure of an airsoft gun may be reduced by not using the engine structure.

BRIEF DESCRIPTION OF DRAWINGS

FIGS. 15A, 15B, and 15C are views illustrating a shooting game system, according to other embodiments of the present disclosure.

BEST MODE

A shooting game system according to an aspect of the present disclosure includes a main body including a muzzle through which a pellet moves, a light-emitting device being mounted in the main body and providing light to the pellet so that the pellet is changed to a fluorescent color in a light-emitting region in the muzzle, a sensor unit configured to detect pulling of a trigger provided on the main body and provide a firing detection signal, a supply unit configured to supply the pellet and compressed gas to the main body, and a control board configured to control the supply unit to provide the pellet and the compressed gas to the main body in response to the firing detection signal, wherein the control board includes an auto tracer controller configured to control the light-emitting device to emit light at a timing when the pellet passes through the light-emitting region in response to the firing detection signal.

MODE OF DISCLOSURE

In the following description, a pellet may be a BB fired by compressed gas. However, the present disclosure is not limited thereto, and the pellet may be any of various types of pellets fired by compressed gas. Preferred embodiments of the present disclosure will now be described in detail.

Figure 1:
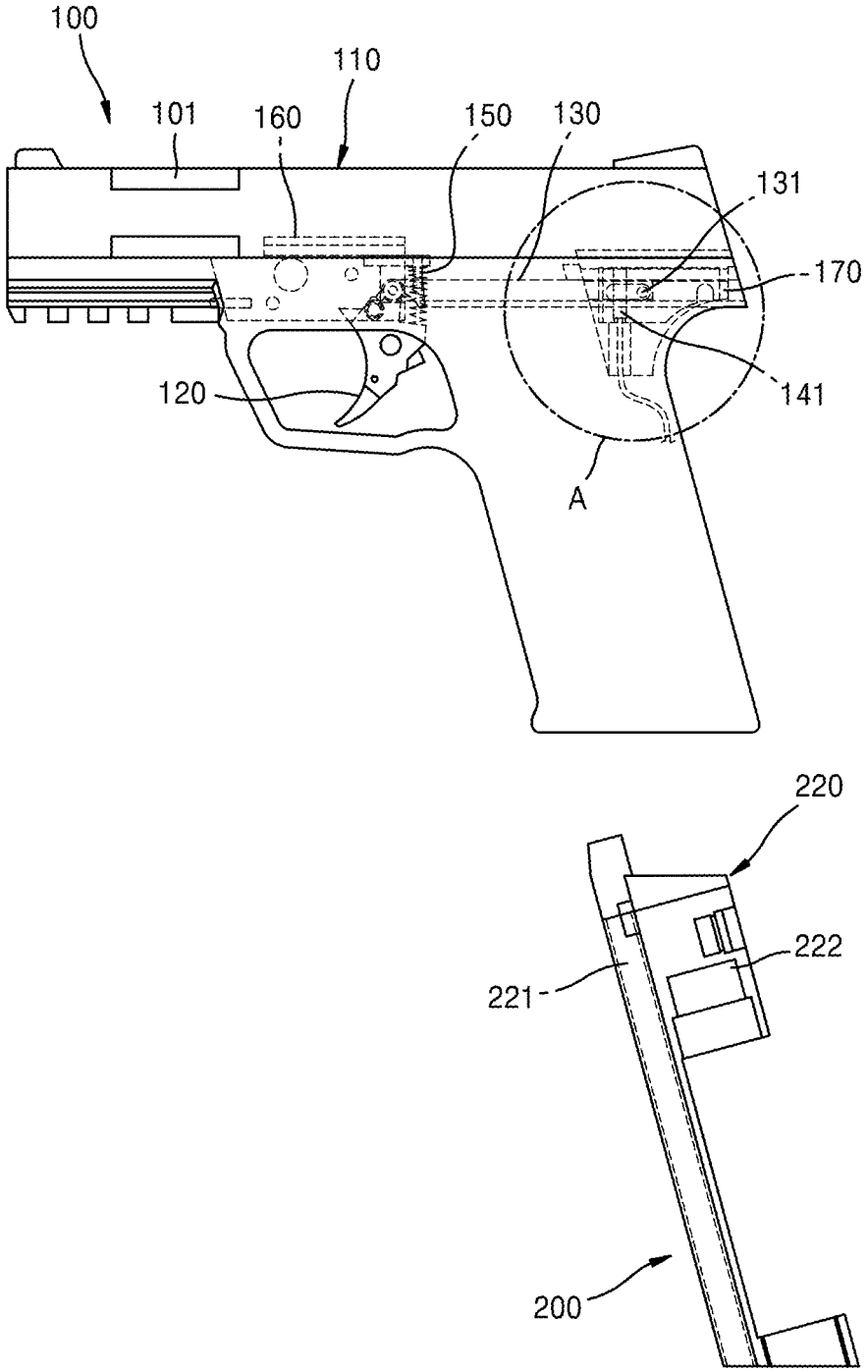
FIG. 1 is a view illustrating an airsoft gun and a magazine unit, according to an embodiment of the present disclosure.
Figure 2:
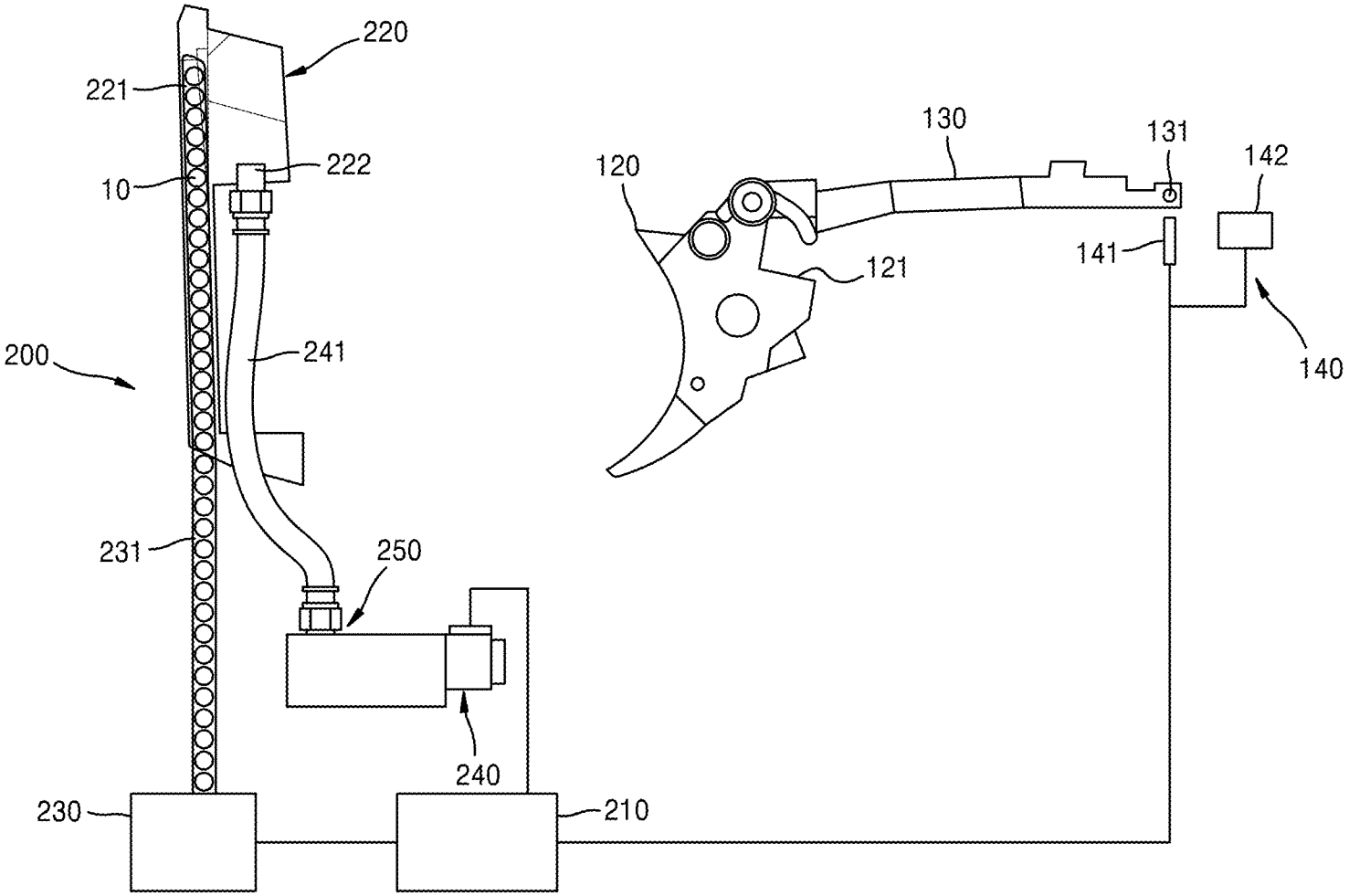
FIG. 2 is a view illustrating a shooting game system using an airsoft gun, according to an embodiment of the present disclosure.

Referring to FIGS. 1 and 2, an airsoft gun and a shooting game system including the same according to an embodiment of the present disclosure includes a main body 110, a trigger 120, a trigger lever 130, a sensor unit 140, a supply unit 200, and a control board 210.

An airsoft gun 100 according to an embodiment of the present disclosure may include at least some of the elements illustrated in FIGS. 1 and 2. For example, the airsoft gun 100 may include the main body 110, the trigger 120, the trigger lever 130, and the sensor unit 140. Also, the control board 210 may be provided in the airsoft gun 100, or may be provided outside the airsoft gun 100. In the shooting game system using the airsoft gun 100 according to an embodiment of the present disclosure, the supply unit 200 may be attached to or detached from the airsoft gun 100, and may provide a pellet and compressed gas to the airsoft gun 100 under the control of the control board 210 when the supply unit 200 is mounted on the airsoft gun 100.

The main body 110 may be a main body of the airsoft gun 100, and may be a housing of the airsoft gun 100 provided with a barrel through which a pellet moves. Various components may be located inside the main body 110, and the trigger 120, the trigger lever 130, and the sensor unit 140 described below may be located inside the main body 110.

The trigger 120 provided on the main body 110 may be pulled by a user. For example, the user may trigger by pulling the trigger 120.

The trigger 120 that may be coupled to the main body 110 may be hinged to the main body 110. In detail, a central shaft of the trigger 120 may be hinged to the main body 110, and when the user pulls the trigger 120, the trigger 120 rotates about the central shaft.

The trigger lever 130 may be connected to the trigger 120, and the trigger lever 130 may be moved by the pulling of the trigger 120. The trigger lever 130 that is coupled to a side of the trigger 120 may have a bar shape.

When the user pulls the trigger 120, the trigger 120 rotates about the central shaft 122, and when the trigger 120 rotates, the trigger lever 130 connected to the trigger 120 is moved. Due to the pulling of the trigger 120, the trigger lever 130 may be moved forward or backward. However, the present disclosure is not limited thereto, and the trigger lever 130 may be variously moved due to the pulling of the trigger 120.

The sensor unit 140 provided in the main body 110 may detect a movement of the trigger lever 130 and may provide a firing detection signal. In order to cause the trigger lever 130 to be moved as described above, the trigger 120 should be pulled. Accordingly, the sensor unit 140 may detect the pulling of the trigger 120 by detecting the movement of the trigger lever 130. That is, when the sensor unit 140 detects the movement of the trigger lever 130, the sensor unit 140 may recognize the movement as a pulling signal of the trigger 120.

The sensor unit 140 may have any of various configurations as long as the sensor unit 140 may detect the movement of the trigger lever 130. In detail, the sensor unit 140 may include any one of a reed sensor 141, a proximity sensor 142, and a micro switch. However, the present disclosure is not limited thereto, and the sensor unit 140 may have any of various configurations as long as the sensor unit 140 may detect the movement of the trigger lever 130, and may use different types of sensors at the same time.

According to an embodiment of the present disclosure, the sensor unit 140 may include the reed sensor 141, and a magnet 131 may be provided on the trigger lever 130. In detail, the trigger lever 130 may have a bar shape, and the magnet 131 may protrude from a side surface of the trigger lever 130. When the trigger lever 130 is moved, the magnet 131 provided on the trigger lever 130 is also moved.

The sensor unit 140 including the reed sensor 141 may be provided on a side of the main body 110, and may be located close to the magnet 131. The reed sensor 141 may detect a change in a magnetic field. When the magnet 131 is moved due to the movement of the trigger lever 130, a magnetic field is changed due to the movement of the magnet 131.

The reed sensor 141 may detect the change in the magnetic field, and may detect the movement of the trigger lever 130 and the pulling of the trigger 120. The reed sensor 141 may be located at any of various points as long as the reed sensor 141 may detect the change in the magnetic field caused by the magnet 131. However, when the reed sensor 141 is located far from the magnet 131, it is difficult to detect the change in the magnetic field caused by the magnet 131 through the reed sensor, and thus, it is preferable that the reed sensor 141 is located close to the magnet 131.

According to an embodiment, as shown in FIG. 1, a light-emitting device 101 may be located inside the main body 110 or the barrel. The light-emitting device 101 may include various types of light-emitting means such as an LED unit. The light-emitting device 101 according to an embodiment of the present disclosure is not limited to the LED unit, and may include any of various types of light-emitting means for providing light and changing a color of a pellet to a fluorescent color.

Due to a firing operation, a pellet moves through the barrel, and a muzzle through which the pellet actually passes is formed inside the barrel. Also, the light-emitting device 101 may be mounted on a surface of the muzzle inside the barrel. When the light-emitting device 101 is driven during the firing operation, an auto tracer function for identifying a movement path through which the pellet is fired out of the main body 110 may be performed.

In an operation, when the control board 210 is provided in the shooting game system as described above and a firing operation by the user is detected, the control board 210 may drive the light-emitting device 101. In an example, a pellet such as a BB may be coated with a material whose color may be changed to a luminous (fluorescent) color due to light emission of the light-emitting device 101. When the light-emitting device 101 is selectively driven by a firing operation by the user, a color of the pellet may be changed to a luminous (fluorescent) color, and thus, the user may easily identify a movement of the pellet through the color, thereby improving the performance of a shooting game and improving game satisfaction by the user. That is, according to an embodiment of the present disclosure, the user's firing detection and an auto tracer function of a pellet through electronic control by the control board 210 may be performed.

According to an embodiment, there may be a time difference between a time when a firing operation of the user is detected and a time when a pellet is actually fired to the outside. According to embodiments of the present disclosure, a firing speed of a pellet may be determined according to various factors such as the amount of air such as compressed gas injected into a magazine, a time at which the pellet is fired to the outside through a muzzle may be determined according to the determined firing speed, and thus, the control board 210 may perform a control operation to optimize an auto tracer function by controlling a driving timing of the light-emitting device 101.

An operation of the shooting game system of FIGS. 1 and 2 will be described as follows.

The supply unit 200 may supply a pellet 10 and compressed gas. The term "compressed gas" may be gas for pushing a pellet such as compressed air or compressed gas, and it may be explained that air is supplied as a higher concept instead of compressed gas. Hereinafter, compressed gas will be described.

A conventional airsoft gun system has a problem in that the risk of failure is increased as a pellet and compressed gas are supplied by using an engine structure including a hammer, a sear, and a firing pin knocker. However, because the shooting game system using the airsoft gun 100 according to an embodiment of the present disclosure supplies the pellet 10 and compressed gas through the sensor unit 140 and the control board 210 without using the engine structure, the risk of failure of the shooting game system using the airsoft gun may be reduced.

In detail, when the sensor unit 140 detects a firing signal of the trigger 120, the sensor unit 140 transmits a firing detection signal of the trigger 120 to the control board 210. The control board 210 controls the supply unit 2000 to supply the pellet and the compressed gas to the main body 110 in response to the firing detection signal.

The supply unit 200 may include a magazine unit 220, a feeder 230, a gas tank 240, and an air valve 250.

The magazine unit 220 may include a pellet moving portion 221 through which the pellet 10 moves and a gas moving portion 222 through which the compressed gas moves. The pellet moving portion 221 is a passage through which the pellet 10 moves to the main body 110, and the gas moving portion 222 is a passage through which the compressed gas moves to the main body 110.

The feeder 230 is separated from the magazine unit 220, is connected to the magazine unit 220 through a pellet connecting portion 231, and stores the pellet 10 therein. The gas tank 240 is connected to the magazine unit 220 through a gas connecting portion 241, and stores the compressed gas therein. The compressed gas stored in the gas tank 240 may be compressed air or compressed gas. However, the present disclosure is not limited thereto, and any of various types of compressed gas for pushing a pellet may be stored in the gas tank 240.

Because a conventional airsoft gun stores pellets and compressed gas in a magazine, the amount of pellets and compressed gas which may be supplied at a time is limited. Accordingly, the conventional airsoft gun has a problem in that pellets and compressed gas should be periodically filled for repeated use. However, the shooting game system using the airsoft gun according to an embodiment of the present disclosure has an advantage in that, because the feeder 230 and the gas tank 240 separated from the magazine unit 220 are provided, the pellet 10 and the compressed gas may be continuously and indefinitely supplied. Also, the shooting game system using the airsoft gun according to an embodiment of the present disclosure has an advantage in that, because the pellet 10 and the compressed gas supplied from the feeder 230 and the gas tank 240 are controlled by the control board 210, the risk of failure may be reduced and the pellet 10 and the compressed gas may be easily supplied to the main body 110.

In detail, the feeder 230 may include a driving device capable of moving the pellet 20 by using power, and the supply unit 200 may include the air valve 250 capable for opening and closing a passage through which the compressed gas moves. The driving device and the air valve 250 may be controlled by the control board 210.

The air valve 250 may be provided at any of various points as long as the air valve 250 may open and close a passage through which the compressed gas moves. The air valve 250 may be provided to open and close a passage through which the compressed gas moves from the gas tank 240 to the gas connecting portion 241, or may be provided to open and close a passage of the gas connecting portion 241 or the gas moving portion 222.

In an example, the driving device may be a motor. A conventional airsoft gun using a magazine is provided with a spring in the magazine and supplies a pellet to an airsoft gun main body. However, the conventional airsoft gun has a problem in that, because the pellet is supplied by using the spring, the risk of failure of the magazine may be increased, and thus, it is difficult to smoothly supply the pellet to the airsoft gun main body. However, the shooting game system using the airsoft gun according to an embodiment of the present disclosure has an advantage in that, because the pellet is supplied through the driving device including a motor without using a spring, the risk of failure may be reduced. Also, the shooting game system using the airsoft gun according to an embodiment of the present disclosure has an advantage in that, because the motor is controlled through the control board 210, the pellet may be smoothly supplied to the main body 110. Although the driving device includes a motor, the present disclosure is not limited thereto, and the driving device may be any of various devices as long as it may move the pellet while operating by power.

A detailed operation of a shooting game system and an auto tracer function according to an embodiment of the present disclosure will be described.

Figure 3:
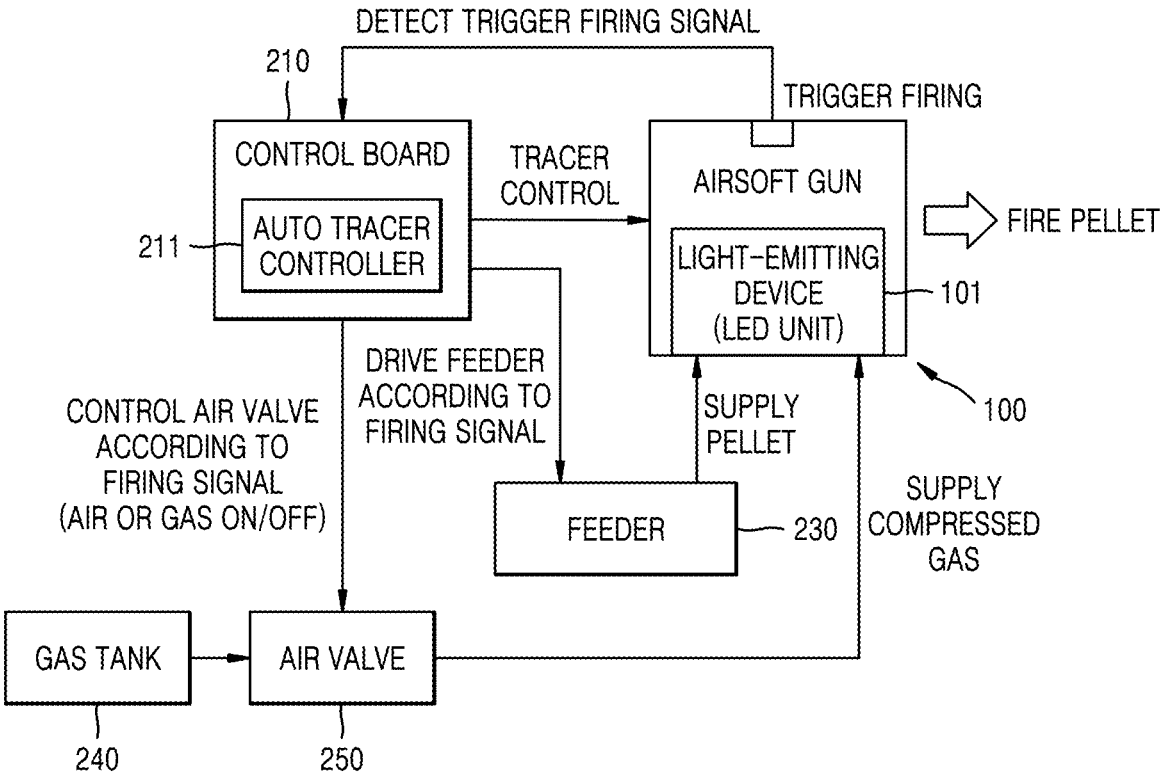
FIG. 3 is a block diagram illustrating an example of driving a shooting game system, according to an embodiment of the present disclosure.

FIG. 3 is a block diagram illustrating an example of driving a shooting game system, according to an embodiment of the present disclosure. In FIG. 3, the same elements as those illustrated in FIGS. 1 and 2 may be denoted by the same reference numerals.

Referring to FIGS. 1 through 3, in order to fire the pellet 10, a user pulls the trigger 120 of the airsoft gun 100. When the trigger 120 is pulled, the sensor unit 140 provides a firing detection signal to the control board 210, the control board 210 controls the driving device of the feeder to supply the pellet 10 to the main body 110 of the airsoft gun 100, and controls the air valve 250 to be opened so that compressed gas is supplied to the main body 110 of the airsoft gun 100. When the pellet 10 and the compressed gas are supplied to the main body 110 of the airsoft gun 100, the pellet 10 is fired from the airsoft gun 100.

The control board 210 may include an auto tracer controller 211, and may perform a tracer control function based on at least one of an operation (or control timing) of controlling the feeder 230 and an operation (or control timing) of controlling the air valve 250. In an example, the auto tracer controller 211 may control the light-emitting device 101 (e.g., LED unit) to emit light while a pellet passes through a muzzle of the airsoft gun 100, by controlling the light-emitting device (e.g., the LED unit 101) in association with a timing of providing compressed gas to the airsoft gun 100, and thus, the pellet receives light in the muzzle and may be changed to a fluorescent color. The auto tracer controller 211 may provide a driving signal for driving the light-emitting device 101. In describing embodiments of the present disclosure, the auto tracer controller 211 may be provided in the control board 210, and an auto tracer control function may be performed by the control board 210.

According to an embodiment, the control board 210 may provide a driving signal for turning on the light-emitting device 101 for a certain period as tracer control, and may control the light-emitting device 101 to be turned on at a timing when a pellet passes through a region (e.g., a light-emitting region) where the light-emitting device 101 is located. For example, the pellet may be coated with a certain material whose color is changed to a fluorescent color by receiving light, and fluorescent characteristics may become stronger by instantaneously providing light to the pellet for a short time. To this end, the control board 210 may perform a control operation so that the light-emitting device 101 is turned on when a certain time elapses (or the control board 210 is moved by a certain distance) after the pellet enters the light-emitting region. The light-emitting device 101 may maintain an ON state for a certain period of time, and the light-emitting device 101 may be turned off, for example, after the pellet is fired out of the airsoft gun or before the pellet is fired out of the airsoft gun.

Figure 4:
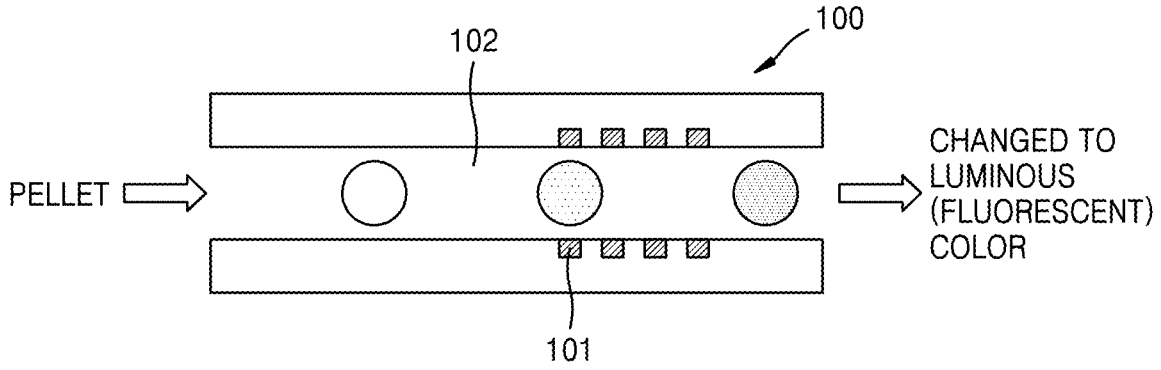
FIG. 4 is a view illustrating the concept of auto tracer control, according to an embodiment of the present disclosure.

FIG. 4 is a view illustrating the concept of auto tracer control, according to an embodiment of the present disclosure.

As shown in FIG. 4, the airsoft gun 100 may include a barrel included in a main body, a muzzle 102 through which a pellet passes may be formed inside the barrel, and the light-emitting device 101 may be located on a surface of the muzzle. The pellet may be coated with a certain material whose color is changed to a fluorescent color, and when the light-emitting device 101 is turned on while the pellet passes through a light-emitting region where the light-emitting device 101 is located, a color of the pellet may be changed to a fluorescent color. When the pellet passes through the light-emitting region and is fired out of the muzzle 102, a user may easily identify a movement of the pellet whose color is changed to the fluorescent color. In particular, a shooting game system using the airsoft gun 100 may be installed indoors, and a place where the shooting game system operates may be generally dark. Because the airsoft gun 100 according to an embodiment of the present disclosure may drive the light-emitting device 101 by considering a timing at which the pellet moves through the muzzle 102, fluorescent characteristics may be effectively provided to the pellet. Also, because the airsoft gun 100 according to an embodiment of the present disclosure may selectively turn on and drive the light-emitting device 101 for a short time, a lifetime of the light-emitting device 101 may be increased.

The light-emitting device 101 may be controlled to be turned on at various timings. For example, the light-emitting device 101 may be controlled to be driven so that the light-emitting device 101 is turned on after the pellet enters the light-emitting region. However, an embodiment of the present disclosure is not limited thereto, and the light-emitting device 101 may be driven so that the light-emitting device 101 has an ON state before the pellet enters the light-emitting region and receives light while the pellet passes through the light-emitting region.

Figure 5A:
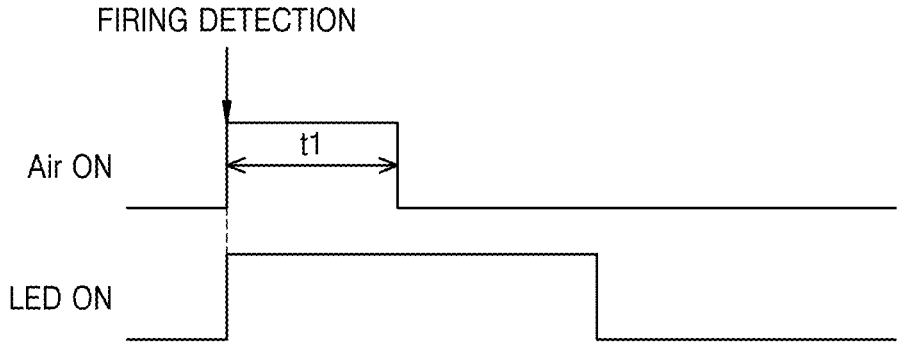
FIGS. 5A, 5B, and 5C are views illustrating various driving examples related to auto tracer control, according to an embodiment of the present disclosure.
Figure 5B:
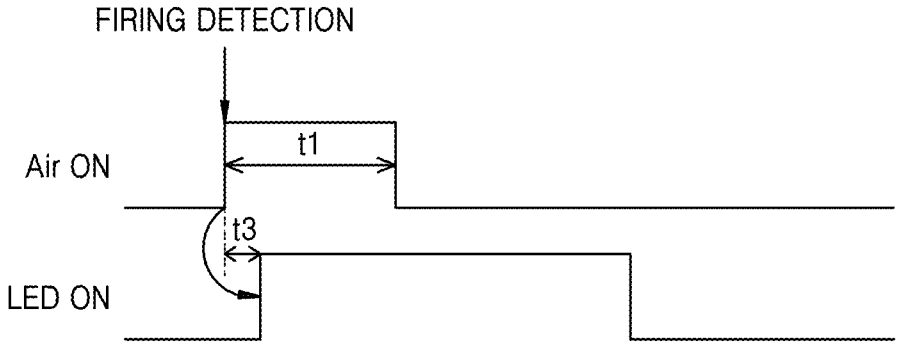
Figure 5C:
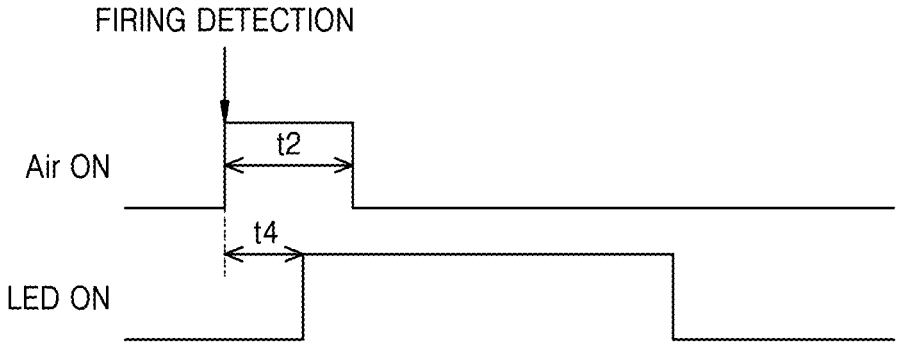

FIGS. 5A, 5B, and 5C are diagrams illustrating various driving examples related to auto tracer control, according to an embodiment of the present disclosure. A control board according to an embodiment of the present disclosure may cause a pellet to be fired by providing the pellet and compressed gas to a main body in response to a firing detection signal. Although the control board controls driving of a light-emitting device in association with a timing of providing compressed gas in an embodiment of FIGS. 5A, 5B, and 5C, an embodiment of the present disclosure is not limited thereto, and the driving of the light-emitting device may be controlled in association with reception of a firing detection signal or in association with an operation of providing a pellet to the main body.

Referring to FIG. 5A, the control board may detect firing according to a firing detection signal, and thus may turn on the light-emitting device at substantially the same timing as a timing of providing compressed gas to the main body (Air ON). The amount of compressed gas may be adjusted and a firing speed of a pellet may be adjusted by adjusting a time when the compressed gas is supplied to the main body. For example, when compressed gas is supplied to the main body for t1 (e.g., 20 msec) and a pellet passes through a muzzle and is fired at a speed corresponding to the amount of supplied compressed gas, a timing at which the pellet passes through a light-emitting region may be determined by the control board.

The light-emitting device may be turned on for a certain period of time. For example, the light-emitting device may be turned on for a period of time longer than the time t1 for which the compressed gas is supplied. For example, the light-emitting device may be turned on for about 50 msec. Even when a timing at which the compressed gas is provided and a timing at which the light-emitting device is turned on are the same, considering a time required to drive the light-emitting device, because the light-emitting device is turned on while the pellet enters the light-emitting region and then moves in the light-emitting region, fluorescent characteristics of the pellet may become stronger by instantaneously providing light to the pellet for a short time.

Referring to FIG. 5B, when the control board detects firing according to a firing detection signal, the control board may provide compressed gas to the main body for t1 (Air ON). Also, the control board may turn on the light-emitting device when a certain delay time t3 elapses after the compressed gas is provided to the main body. Because the light-emitting device is turned on while a pellet enters the light-emitting region and then moves in the light-emitting region, fluorescent characteristics of the pellet may become stronger by instantaneously providing light to the pellet for a short time as described above. Accordingly, the control board may provide a certain delay to a timing at which the light-emitting device is turned on based on a timing at which the compressed gas is provided to the main body.

Referring to FIG. 5C, when the control board detects firing according to a firing detection signal, the control board may provide compressed gas to the main body for t2 (Air ON). For example, the time t2 for which the compressed gas is provided in FIG. 5C may be shorter than the time t1 for which the compressed gas is provided in FIGS. 5A and 5B, and thus, in FIG. 5C, a movement speed of a pellet may be relatively slow.

The control board may turn on the light-emitting device when a certain delay time t4 elapses after the compressed gas is provided to the main body. Driving of the light-emitting device may be controlled so that the light-emitting device is turned on while a pellet enters the light-emitting region and then moves in the light-emitting region as described above. The delay time t4 of FIG. 5C may be longer than the delay time t3 of FIG. 5B. That is, when a movement speed of the pellet is relatively slow, a timing at which the pellet reaches the light-emitting region may also be slow. The light-emitting device may be driven by controlling a delay time as shown in FIGS. 5B and 5C.

Figure 6:
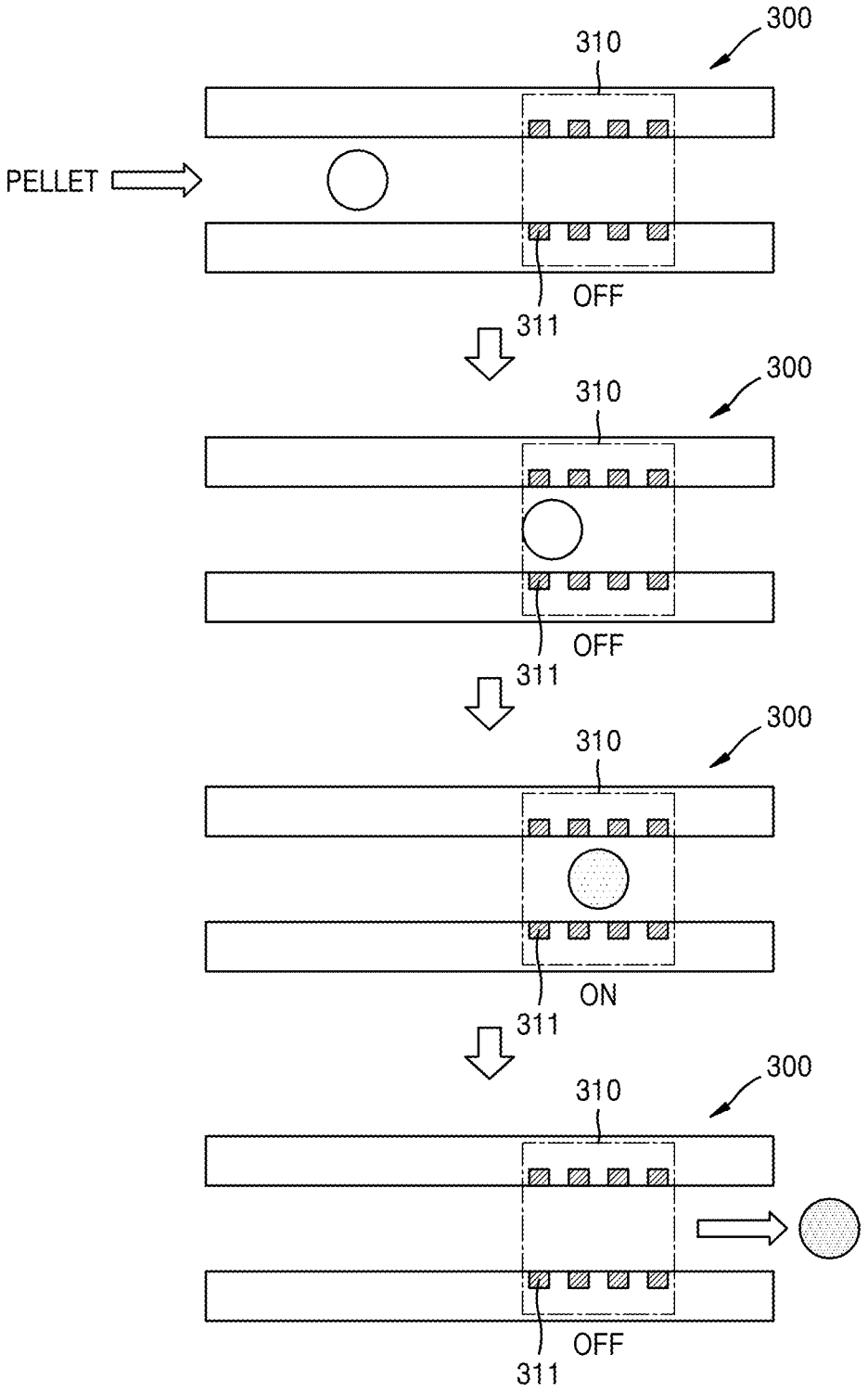
FIG. 6 is a view illustrating an example of moving a pellet and driving a light-emitting device.

FIG. 6 is a view illustrating an example of moving a pellet and driving a light-emitting device. In FIG. 6, a light-emitting device is turned on while a pellet enters a light-emitting region and then moves in the light-emitting region.

Referring to FIG. 6, according to the above embodiments, a control board may supply a pellet and compressed gas to a main body 300 in response to a firing detection signal, and the pellet at a speed based on one or more factors including the amount of supplied compressed gas. Also, the control board may control driving of the light-emitting device 311 according to the above embodiments in order to provide fluorescent characteristics to the pellet.

The pellet may move and enter a muzzle. Before the pellet enters a light-emitting region 310 in the muzzle, the light-emitting device 311 may maintain an OFF state. Also, even at a time when the pellet enters the light-emitting region 310, the light-emitting device 311 may maintain the OFF state, and the light-emitting device 311 may be changed to an ON state while the pellet moves in the light-emitting region 310. Accordingly, light may be instantaneously provided to the pellet for a period of time where the pellet passes through the light-emitting region 310 from a timing at which the light-emitting device 311 is turned on, and a certain material coated on the pellet may receive light and may be changed to a fluorescent color.

Figure 7:
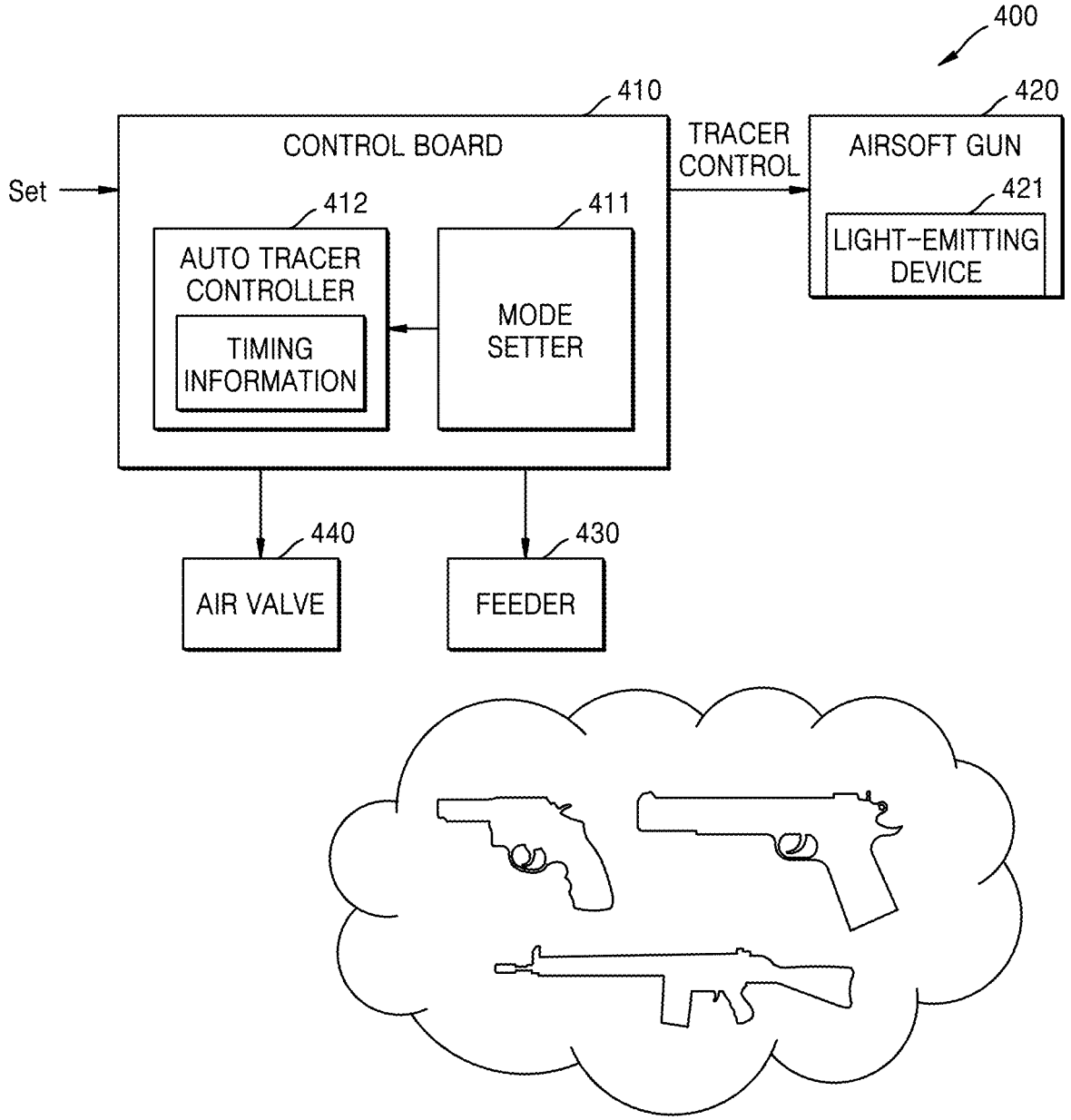
FIG. 7 is a block diagram illustrating a shooting game system, according to an embodiment of the present disclosure.

According to the above embodiments, the light-emitting device 311 may be turned on for a certain period of time, and as in the last drawing of FIG. 7, the light-emitting device 311 may be turned off again after the pellet is fired out of the muzzle. According to an embodiment, when the light-emitting device 311 is turned on for a certain period of time, the light-emitting device 311 may be turned off after the pellet passes through the light-emitting region 310 and before the pellet is fired out of the muzzle.

FIG. 7 is a block diagram illustrating a shooting game system, according to an embodiment of the present disclosure.

Referring to FIG. 7, a shooting game system 400 may include a control board 410, an airsoft gun 420, a feeder 430, and an air valve 440. Although not shown in FIG. 7, other elements required for a shooting game described in the above embodiments may also be included in the shooting game system 400. Also, the feeder 430 and the air valve 440 may be provided outside the airsoft gun 420 and may provide compressed gas and a pellet to the airsoft gun 420. The control board 410 may be provided in the airsoft gun 420, or may be provided outside the airsoft gun 420. That is, in defining a configuration of the present disclosure, regardless of a position at which the control board 410 is located, the airsoft gun 420 may include the control board 410. According to embodiments of the present disclosure, an operation by which the control board 410 controls the feeder 430 and the air valve 440 is the same as or similar to that in the above embodiments, and thus, a detailed description thereof will be omitted.

Various types of airsoft guns may be employed in the shooting game system 400. For example, various types of airsoft guns such as a pistol having a short muzzle, a pistol having a long muzzle, a rifle having a longest muzzle, and a long gun may be employed. Also, a light-emitting device according to the above embodiments may be applied to the various types of airsoft guns. In this case, because a distance by which a pellet moves in a muzzle may vary according to a type of an airsoft gun and the amount of supplied compressed gas may vary also according to a type of an airsoft gun, driving of the light-emitting device may be controlled based on an airsoft gun employed in the shooting game system 400 according to embodiments of the present disclosure.

The control board 410 may include a mode setter 411 and an auto tracer controller 412, and the auto tracer controller 412 may include timing information that may be used in driving control of the light-emitting device. The mode setter 411 may set a mode according to a type of the airsoft gun employed in the shooting game system 400 based on a user's setting. For example, information of various types of airsoft guns which may be employed in the shooting game system 400 may be set, and the mode setter 411 may set an operation mode of the shooting game system 400 based on the user's selection.

Although not shown in FIG. 7, the control board 410 may differently set an operating method of the shooting game system 400 based on the mode setting. For example, based on the mode setting according to the employed airsoft gun, the amount of compressed gas provided to the airsoft gun 420 may be varied, and also, supply of a pellet to the airsoft gun 420 may be differently set. For example, in the case of a long gun, a repeating function along with a single shoot may be employed. When a firing mode of the airsoft gun 420 is set to a repeating mode or a trigger is pulled for a long time for a certain period, a pellet may be fired. A plurality of pellets may be continuously fired by controlling a motor (not shown) of a supply unit or the like.

According to the above embodiments, a light-emitting region may be mounted inside a muzzle of each of various types of airsoft guns, and when a pellet exists in the light-emitting region, light needs to be provided to the pellet by driving a light-emitting device. Timing information may include timing information for driving the light-emitting device in relation to various modes, and may include, for example, information indicating that the light-emitting device is turned on for a certain period after firing is detected. For example, information related to a time for which the light-emitting device maintains an ON state along with a timing at which the light-emitting device is turned on may be included in the timing information.

The auto tracer controller 412 may control driving of the light-emitting device based on the timing information, and thus, a timing at which the light-emitting device 421 is turned on and/or a time for which the light-emitting device maintains an ON state after firing is performed may be differently controlled according to the airsoft gun. Also, the timing information may include information about a timing at which the light-emitting device is turned on and/or a time for which the light-emitting device maintains an ON state after firing is performed when a firing mode is set to a repeating mode. Although not shown in FIG. 7, when firing is performed in a repeating mode in an operation of the shooting game system 400, the control board 410 may provide information indicating this to the auto tracer controller 412. When pellets are fired in a repeating mode, the auto tracer controller 412 may control the light-emitting device 421 to be turned on at a timing when a first pellet moves through a muzzle, and may control the light-emitting device 421 to maintain an ON state until a time when a last pellet is fired through the muzzle. Alternatively, when pellets are fired in a repeating mode, time information about a firing interval of pellets may be included in the control board 410, and the auto tracer controller 412 may perform a control operation so that the light-emitting device 421 is turned on and turned off for each pellet.

Figure 8:
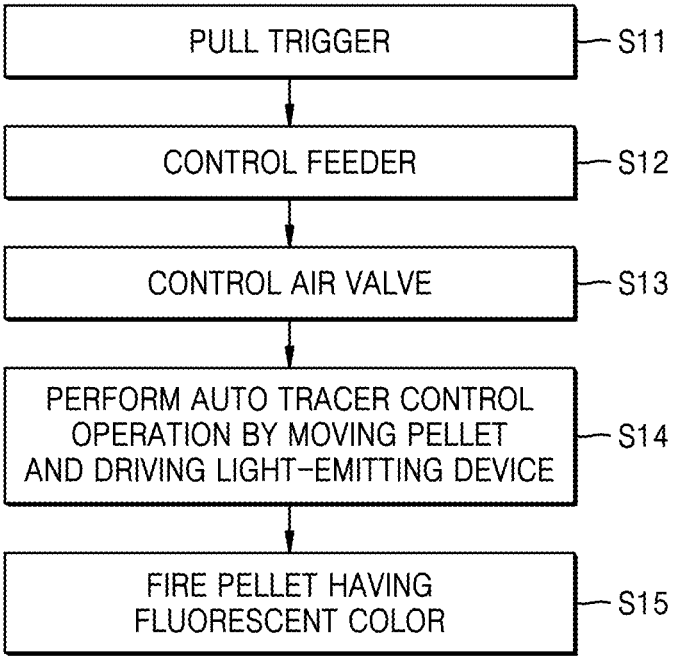
FIG. 8 is a flowchart illustrating a method of driving a shooting game system, according to an embodiment of the present disclosure.

FIG. 8 is a flowchart illustrating a method of driving a shooting game system, according to an embodiment of the present disclosure.

Referring to FIG. 8, a shooting game system may include an airsoft gun and may include elements located outside the airsoft gun such as a feeder, a gas tank, and an air valve according to the above embodiments. Firing of the airsoft gun may be electrically detected by a sensor unit, and may be provided to a control board. For example, when a user pulls a trigger of the airsoft gun (S11), the sensor unit may detect pulling of the trigger and may provide a firing detection signal to the control board, and the control board may control the feeder in response to the firing detection signal (S12) and may control the air valve (S13). According to the control of the feeder and the air valve by the control board, a pellet may be fired through a muzzle, and an auto tracer control operation may be performed by driving a light-emitting device including an LED unit or the like (S14).

According to the above embodiments, while the pellet moves through a light-emitting region in the muzzle, the light-emitting device may be turned on to provide light to the pellet, and a material coated on the pellet may be changed to a fluorescent color by receiving the light, thereby making it possible to fire the pellet having a fluorescent color (S15).

Figure 9A:
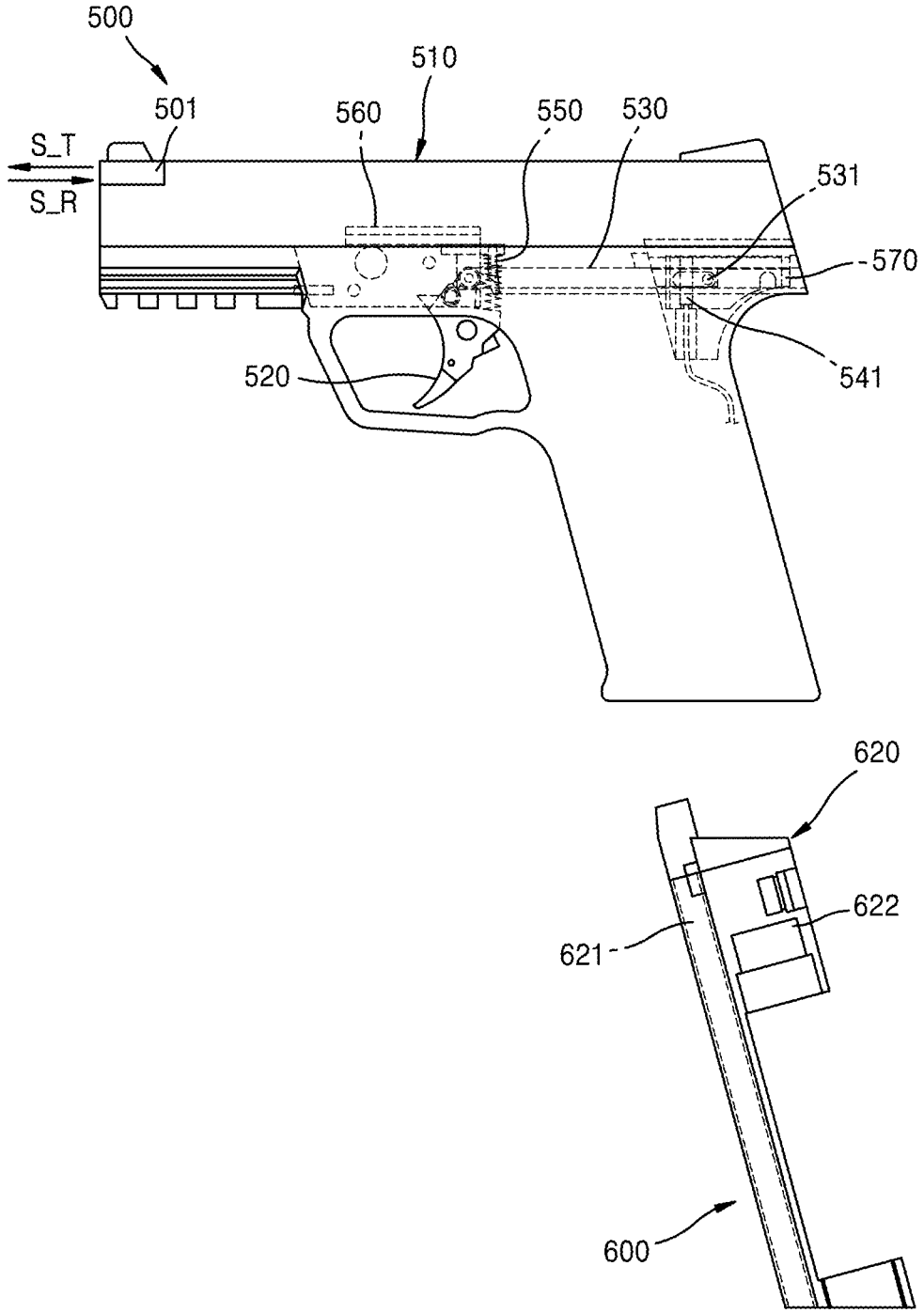
FIGS. 9A and 9B are views illustrating an airsoft gun and a shooting game system including the same, according to an embodiment of the present disclosure.
Figure 9B:
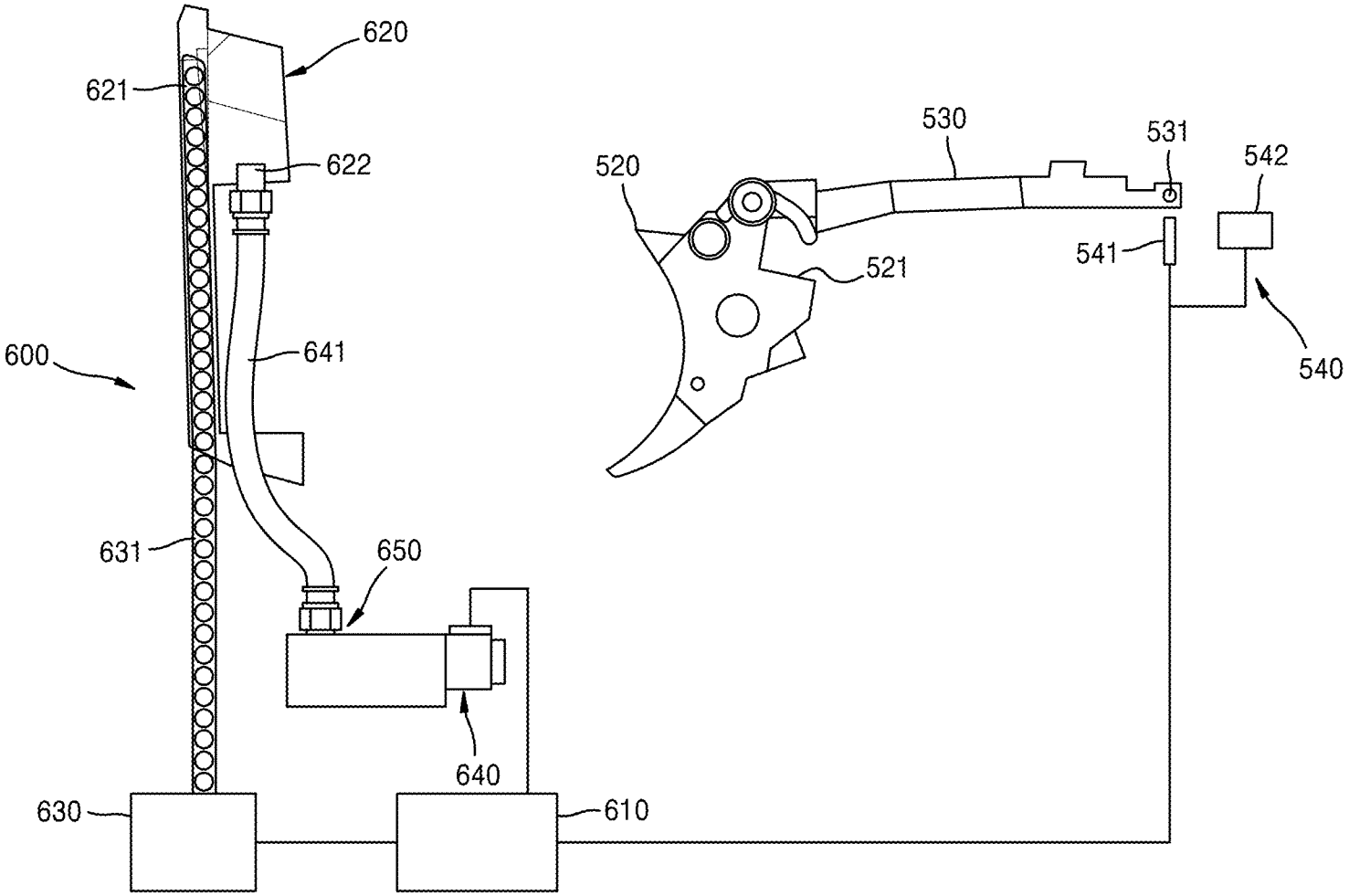

FIGS. 9A and 9B are views illustrating an airsoft gun and a shooting game system including the same, according to another embodiment of the present disclosure.

Referring to FIGS. 9A and 9B, the airsoft gun and the shooting game system including the same according to an embodiment of the present disclosure includes a main body 510, a trigger 520, a trigger lever 530, a sensor unit 540, a supply unit 600, and a control board 610. The sensor unit 540 may include any one of a reed sensor 541, a proximity sensor 542, and a micro switch. However, the present disclosure is not limited thereto, and the sensor unit 540 may have any of various configurations as long as the sensor unit 540 may detect a movement of the trigger lever 530, and may use different types of sensors at the same time.

According to an embodiment of the present disclosure, the sensor unit 540 may include the reed sensor 541, and a magnet 531 may be provided on the trigger lever 530. In detail, the trigger lever 530 may have a bar shape, and the magnet 531 may protrude from a side surface of the trigger lever 530. When the trigger lever 530 is moved, the magnet 531 provided on the trigger lever 530 is also moved.

According to an embodiment, as shown in FIG. 1, a distance detection sensor 501 may be located outside or inside the main body 510 or a barrel. Due to a firing operation, a pellet moves through the barrel, and a muzzle through which the pellet actually passes is formed inside the barrel. The distance detection sensor 501 may include various types of distance measuring means. For example, the distance detection sensor 501 may emit light having a certain wavelength as a sensing transmission signal S_T, may receive light reflected from a target as a sensing reception signal S_R, and may detect a distance to the target based on the received sensing reception signal S_R. Also, the distance detection sensor 501 may be located at any of various positions in the airsoft gun as long as the distance detection sensor 501 may detect an appropriate distance to the target. The distance detection sensor 501 according to an embodiment of the present disclosure may be any of various types of sensors such as a sensor having a means for emitting light such as ultrasonic waves as well as a sensor including a means for emitting light such as infrared rays.

In an operation, the control board 610 may be provided in the shooting game system according to the above embodiments, and a distance detection result of the distance detection sensor 501 may be provided to the control board 610. The control board 610 may control a pellet firing operation of the airsoft gun 500 based on a distance detection result, and for example, when a detected distance is out of a certain distance range from a preset target, the control board 610 may perform a control operation so that a pellet is not fired. When a person or the like exists between the airsoft gun 500 and the target and a distance detection result is shorter than a certain distance range, a pellet is not fired, thereby removing the risk of firing the pellet.

According to an embodiment, the control board 610 may control the supply unit 600 to provide a pellet and compressed gas to the airsoft gun 500, and may control an operation of detecting a movement of the trigger lever 530 by driving the sensor unit 540. The control board 610 may control a pellet firing operation based on electrical or electronic control in various ways based on a distance detection result. For example, the control board 610 may control the supply unit 600 so that a pellet is not fired or is very weakly fired, thereby removing or reducing the risk. Also, according to an embodiment, the control board 610 may control, even when pulling is performed by a user, the pulling not to be detected by inactivating the sensor unit 540, and thus, when an object such as a person is detected at a close distance, the control board 610 may control a pellet not to be fired.

An operation of the shooting game system of FIGS. 9A and 9B will be described.

In detail, when the sensor unit 540 detects a firing signal of the trigger 520, the sensor unit 540 transmits a firing detection signal of the trigger 520 to the control board 610. The control board 610 controls the supply unit 600 to supply a pellet and compressed gas to the main body 510 in response to the firing detection signal. The supply unit 600 may include a magazine unit 620, a feeder 630, a gas tank 640, and an air valve 650.

The magazine unit 620 may include a pellet moving portion 621 through which a pellet moves and a gas moving portion 622 through which compressed gas moves. The pellet moving portion 621 is a passage through which the pellet moves to the main body 510, and the gas moving portion 622 is a passage through which the compressed gas moves to the main body 510. The feeder 630 is separated from the magazine unit 620, is connected to the magazine unit 620 through a pellet connecting portion 631, and stores the pellet therein. The gas tank 640 is connected to the magazine unit 620 through a gas connecting portion 641, and stores the compressed gas therein.

The feeder 630 may include a driving device capable of moving the pellet by using power, and the supply unit 600 may include the air valve 650 capable of opening and closing a passage through which the compressed gas moves. The driving device and the air valve 650 may be controlled by the control board 610. Also, the amount of supplied compressed gas may be controlled through control of the air valve 650, and a firing speed of the pellet may be adjusted by adjusting the amount of supplied compressed gas.

A detailed operation related to a function of a shooting game system according to an embodiment of the present disclosure will be described.

Figure 10:
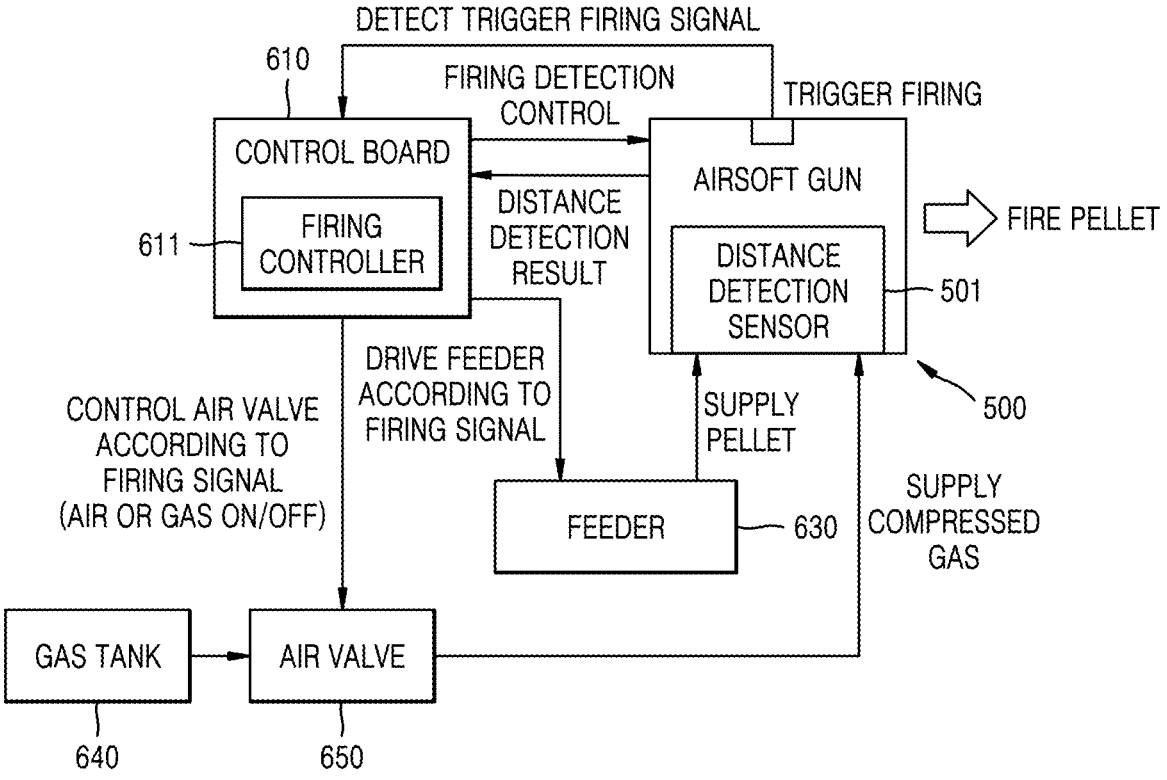
FIG. 10 is a block diagram illustrating an example of driving a shooting game system, according to an embodiment of the present disclosure.

FIG. 10 is a block diagram illustrating an example of driving a shooting game system, according to an embodiment of the present disclosure.

Referring to FIGS. 9A, 9B, and 10, in order to fire a pellet, a user pulls the trigger 520 of the airsoft gun 500. When the trigger 520 is pulled, the sensor unit 540 may provide a firing detection signal to the control board 610, the control board 610 controls the driving device of the feeder 630 to supply a pellet to the main body 510 of the airsoft gun 500, and controls the air valve 650 to be opened so that compressed gas is supplied to the main body 510 of the airsoft gun 500. When the pellet and the compressed gas are supplied to the main body 510 of the airsoft gun 500, the pellet is fired from the airsoft gun 500.

The control board 610 may include a firing controller 611, and the firing controller 611 may control firing (or firing mode) based on a detection result from the distance detection sensor 501. According to an embodiment, the firing controller 611 may control a firing operation based on at least one of an operation of controlling the feeder 630 (e.g., feeder activation) and an operation of controlling the air valve 650 (e.g., compressed gas supply activation). Also, the firing controller 611 may provide a signal for firing detection control to the airsoft gun 500, and may control the sensor unit 540 to be inactivated so that even when the user pulls the trigger 520, a firing detection signal is not generated, thereby blocking the pellet from being fired.

In an operation, when a detection result from the distance detection sensor 501 is within a preset certain distance range from a target, the firing controller 611 normally drives the feeder 630 and the air valve 650 to fire a pellet. In contrast, when a detection result from the distance detection sensor 501 is out of the certain distance range, the firing controller 611 may control a pellet not to be normally fired by inactivating at least one of the feeder 630 and the air valve 650. For example, in a case where the feeder 630 is inactivated, even when compressed gas is supplied, a pellet is not supplied to the main body 510, and thus, the pellet is not actually fired. Also, in a case where the air valve 650 is inactivated or only a small amount of compressed gas is supplied, even when a pellet is supplied to the main body 510, the pellet may not be actually fired or may be very weakly fired, thereby effectively ensuring stability. Also, in a case where the firing controller 611 prevents pellet firing by inactivating the sensor unit 540, even when the user pulls the trigger 520, a firing detection signal is not provided to the control board 610, and thus, a pellet and compressed gas may not be provided to the main body 510, thereby preventing firing of the pellet.

In describing embodiments of the present disclosure, the firing controller 611 may be provided in the control board 610, and a safe distance control function may be performed by the control board 610. Also, because a firing blocking operation according to a distance detection result is electrically or electronically controlled, the risk of failure may be reduced compared to a case of mechanically blocking pellet firing, and because a blocking speed in a very high-speed firing operation may be rapidly controlled, stability may be maximized.

Figure 11:
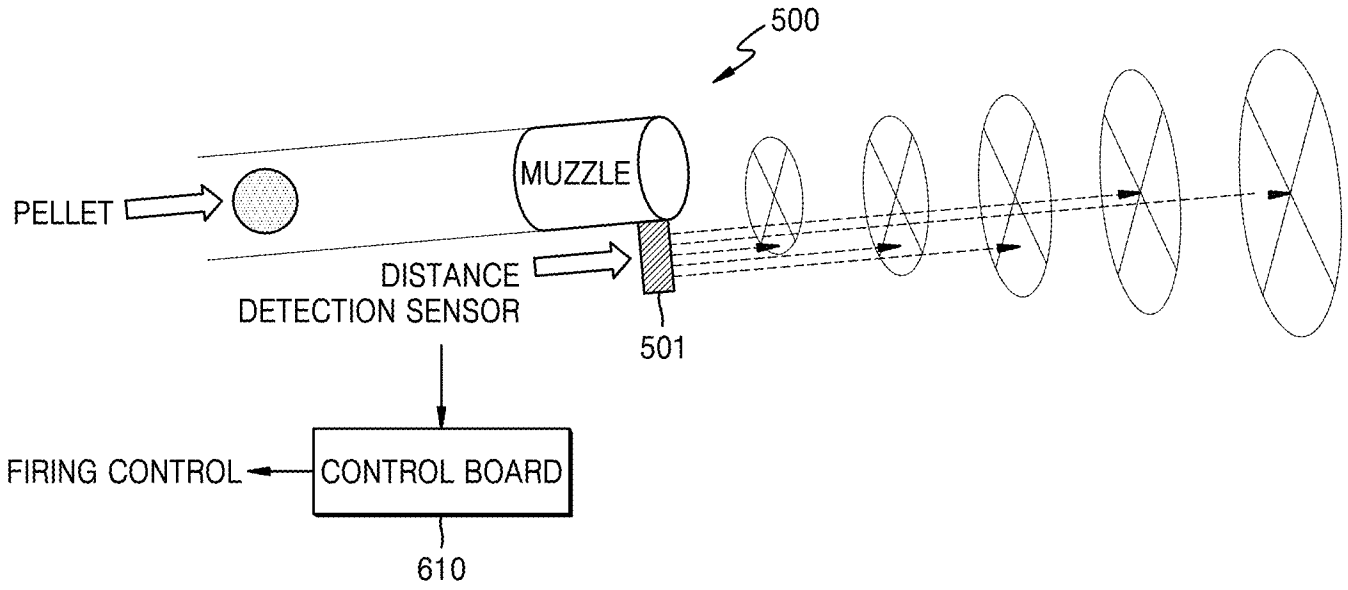
FIG. 11 is a view illustrating the concept of controlling pellet firing according to a distance detection result, according to an embodiment of the present disclosure.

FIG. 11 is a view illustrating the concept of pellet firing control according to a distance detection result, according to an embodiment of the present disclosure.

Referring to FIGS. 9A, 9B, through 11, the airsoft gun 500 may include a barrel included in a main body, a muzzle through which a pellet passes may be formed in the barrel, and the distance detection sensor 501 may be located on a side of the airsoft gun 500. According to the airsoft gun 500 of FIG. 11, a pellet such as a BB may be fired to the outside through the muzzle, and the distance detection sensor 501 for detecting a distance to an external target (e.g., a structure such as a screen or a target on which the pellet is hit) and/or an obstacle (e.g., an object such as a person located closer than the target) which may be detected separately from the external target may be located inside an end (e.g., a distal end of the muzzle) of the muzzle. Also, the distance detection sensor 501 may communicate with the control board 610 according to the above embodiments. For example, the distance detection sensor 501 may provide a result of detecting distance to the external target and the obstacle to the control board 610. Also, a firing control device for electrically/electronically or physically controlling a pellet firing function may be provided in the airsoft gun 500 or the shooting game system. For example, pellet firing may be blocked based on various methods, such as blocking pellet firing by blocking supply of a pellet or compressed gas by using the control board 610 or physically blocking pellet firing by using a structure in the airsoft gun 500.

The distance detection sensor 501 may be mounted around the muzzle (e.g., lower end, upper portion, or side surface) of the airsoft gun 500, and a control operation may be performed by detecting the target of the certain distance to perform or block pellet firing. The distance detection sensor 501 may be implemented in various ways. For example, a device capable of detecting a distance from 1 mm to 10,000 mm may be applied. Accordingly, pellet firing may be limited by detecting a dangerous object at a close distance.

In an operation, a pellet fired from the airsoft gun 500 may reach a target, and a distance between the airsoft gun 500 and the target in an initial operation or initial setting may be detected by the distance detection sensor 501. The detected distance may be stored in the shooting game system, and when a distance detected by the distance detection sensor 501 after a shooting game starts corresponds to the distance detected in the initial operation, the shooting game may be normally performed. That is, without needing to previously set an appropriate distance range corresponding to the target, a setting process may be performed in an initial operation, a certain distance range may be determined and set in the shooting game system based on a distance to the target detected in the setting process, and then a pellet firing operation may be controlled to be performed or blocked by comparing a distance detected by the distance detection sensor 501 with the set distance range, based on the distance range set in a shooting game process.

For example, when the user aims the muzzle of the airsoft gun 500 away from a target while the shooting game is performed, a distance detected by the distance detection sensor 501 may be changed, and when a dangerous object such as a person or another object exists between the airsoft gun 500 and the target, a distance detected by the distance detection sensor 501 may be changed. As described above, because a distance range in which pellet firing is performed based on a distance detected in an initial setting process may be calculated, a function of the distance detection sensor 501 may be continuously or periodically performed in the course of a shooting game, and when a distance out of the distance range in which firing is possible is detected, pellet firing may be blocked through an electrical or electronic method as described above, thereby improving stability.

Although the distance detection sensor 501 detects both a target and an obstacle in the above embodiment, an embodiment of the present disclosure is not limited thereto. For example, a proximity sensor separate from the distance detection sensor 501 may be further located, and any of various types of sensors for detecting an obstacle close to the airsoft gun 500 through any of various sensing methods may be applied as the proximity sensor. When the proximity sensor recognizes a close obstacle and provides a detection result to the control board 610 during a shooting game, the control board 610 may block firing through various electrical or electronic controls according to the above embodiments.

Various driving examples related to firing control according to an embodiment of the present disclosure will be described.

Figure 12A:
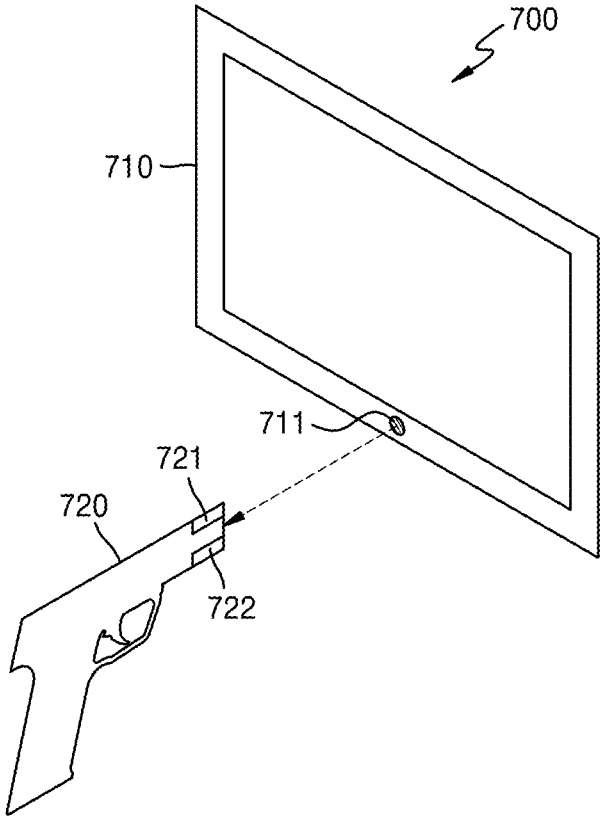
FIGS. 12A and 12B are views illustrating an example of muzzle direction detection and pellet firing control, according to an embodiment of the present disclosure.
Figure 12B:
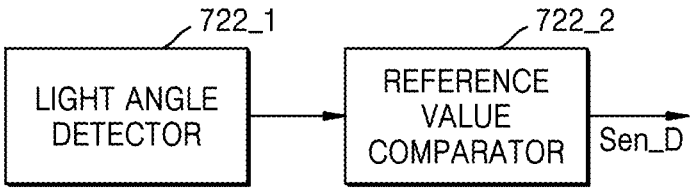

FIGS. 12A and 12B are views illustrating an example of muzzle direction detection and pellet firing control, according to an embodiment of the present disclosure.

Referring to FIGS. 12A and 12B, a shooting game system 700 may include a display device 710 and an airsoft gun 720. Also, although not shown in FIGS. 12A and 12B, the shooting game system 700 may further include a computer device for controlling a screen including a target to be displayed on the display device 710 by driving a shooting game program.

According to an embodiment, the display device 710 may include a light transmitter 711 for emitting light having a certain wavelength. In an example, although the light transmitter 711 may be a device capable of emitting light having a specific wavelength which may not be perceived by the human eye such as infrared rays, an embodiment of the present disclosure is not limited thereto, and a device for transmitting various types of signals which may be detected by the airsoft gun 720 may be mounted on the display device 710.

The airsoft gun 720 may include a light detector 722 for detecting an incidence angle of light emitted from the light transmitter 711, along with a distance detection sensor 721 according to the above embodiments. Although not shown in FIG. 12A, the shooting game system 700 may further include a supply unit for supplying compressed gas and a pellet to the airsoft gun 720, along with a control board for controlling an overall operation related to pellet firing of the airsoft gun 720. Also, according to the above embodiments, the control board may control a pellet firing operation based on a distance detection result from the distance detection sensor 721.

The light detector 722 may detect a direction of a muzzle of the airsoft gun 720, and may determine whether the direction of the muzzle is appropriately aimed at the target (e.g., screen of the display device 710). For example, the light detector 722 may include a light angle detector 722_1 and a reference value comparator 722_2. The light angle detector 722_1 may provide a result of detecting an incidence angle of light provided from the light transmitter 711, and the reference value comparator 722_2 may determine whether a direction of the muzzle is appropriately aimed at the target by comparing the detected incidence angle of light with a certain reference value. For example, the angle of light incident from the light transmitter 711 may vary according to the direction of the muzzle of the airsoft gun 720, and it may be determined whether the muzzle of the airsoft gun 720 is appropriately aimed at a display screen within a frame of the display device 710 by comparing the detected incidence angle of light with the certain reference value. Also, the light detector 722 may output a detection signal Sen_D indicating whether the muzzle of the airsoft gun 720 is appropriately aimed at the display screen based on a result of the determination.

The control board may control a pellet firing operation according to the above embodiments by combining detection results from the distance detection sensor 721 and the light detector 722. For example, the detection result of the distance detection sensor 721 may indicate whether an obstacle exists or does not exist between the airsoft gun 720 and the display device 710, and also, the detection result from the light detector 722 may indicate whether the muzzle of the airsoft gun 720 is appropriately aimed at a screen area of the display device 710. That is, under the control of the control board, pellet firing may be controlled from being blocked when the muzzle of the airsoft gun 720 is directed to the obstacle such as a person or out of the target, thereby improving stability.

Figure 13:
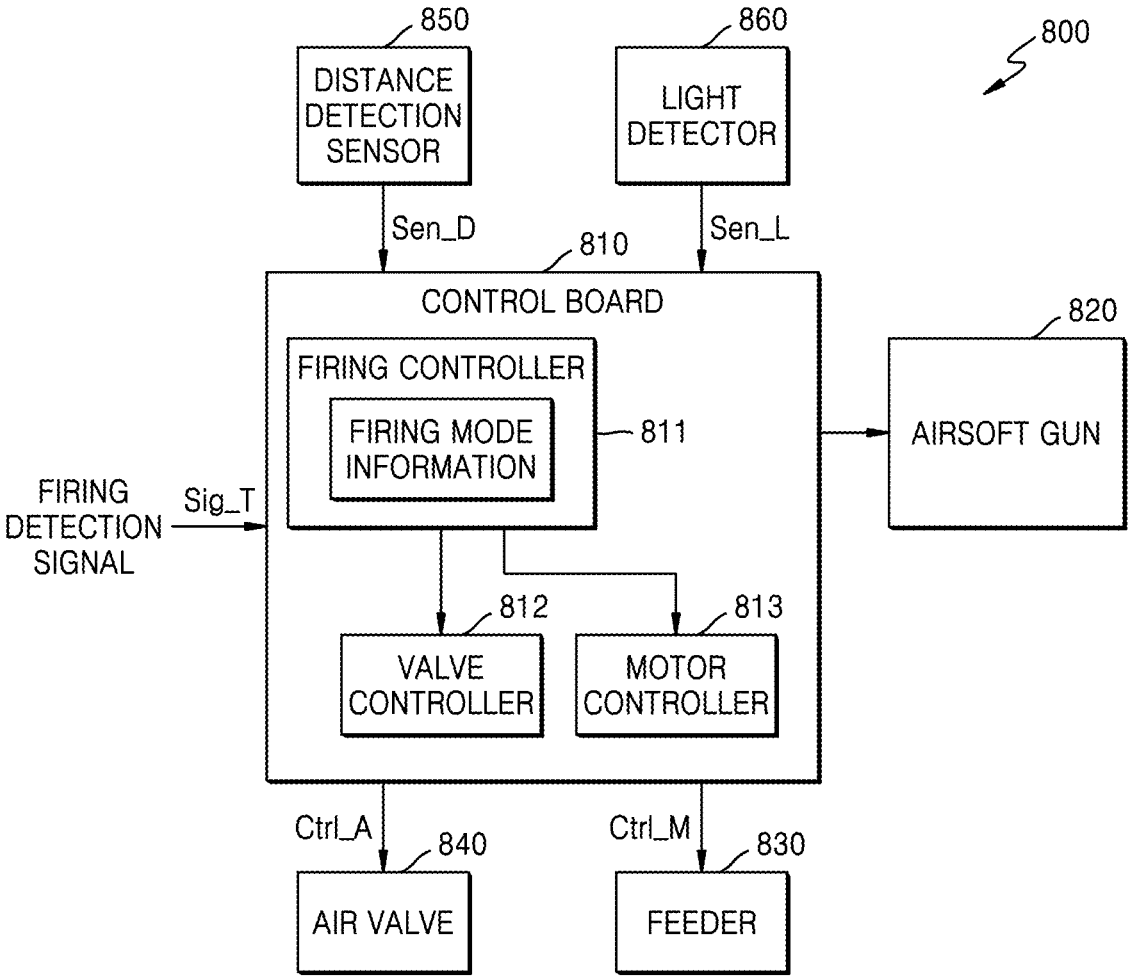
FIG. 13 is a block diagram illustrating an operation of a shooting game system, according to an embodiment of the present disclosure.

FIG. 13 is a block diagram illustrating an operation of a shooting game system, according to an embodiment of the present disclosure.

Referring to FIG. 13, a shooting game system 800 may include a control board 810 and an airsoft gun 820, and may further include a feeder 830, an air valve 840, a distance detection sensor 850, and a light detector 860 according to the above embodiments. Also, the control board 810 may include a firing controller 811, a valve controller 812, and a motor controller 813. In FIG. 13, a detailed description of operations of elements which are the same as those described in the above embodiments will be omitted.

The valve controller 812 may control the air valve 840 to block compressed gas from being provided to a main body of the airsoft gun 820 or adjust the amount of compressed gas provided to the main body. Also, the feeder 830 may provide a pellet to the main body of the airsoft gun 820 based on driving of a motor (not shown), and the motor controller 813 may control the motor of the feeder 830 to block a pellet from being provided to the main body of the airsoft gun 820.

The firing controller 811 may control a pellet firing operation based on a distance detection result Sen_D from the distance detection sensor 820, a direction detection result Sen_L from the light detector 860, and a trigger firing signal Sig_T. The firing controller 811 may include firing mode information so that a pellet firing operation is controlled according to various firing modes based on combinations of the detection results and the firing signal, and may control the valve controller 812 and the motor controller 813 based on a selected firing mode. Also, under the control of the firing controller 811, the valve controller 812 may block or adjust the air valve 840 by providing a valve control signal Ctrl_A to the air valve 840, and the motor controller 813 may block motor driving of the feeder 830 by providing a motor control signal Ctrl_M to the feeder 830.

According to an embodiment, the firing mode information may include information so that various firing modes are performed based on a combination of the distance detection result Sen_D and the direction detection result Sen_L, and according to a selected firing mode, a firing blocking operation using control of the air valve 840 and a firing blocking operation using control of the feeder 830 may be performed, or a firing blocking operation using control of a sensor unit mounted in the airsoft gun 820 and capable of detecting trigger firing may be performed. For example, in some modes of the firing mode information, a control operation may be performed so that a pellet is not fired, or in some other modes, a control operation may be performed so that a pellet is fired but a firing speed of the pellet is greatly lowered to remove or reduce the risk.

Figure 14:
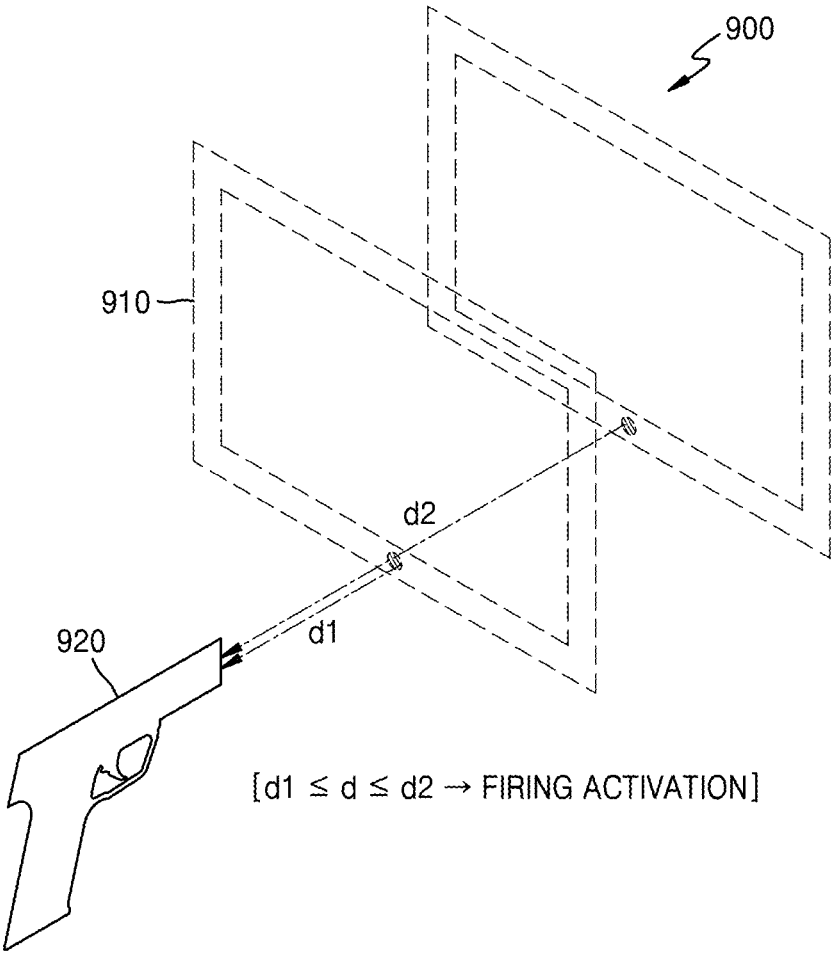
FIG. 14 is a view illustrating a shooting game system which may be implemented according to embodiments of the present disclosure.

FIG. 14 is a view illustrating a shooting game system which may be implemented according to embodiments of the present disclosure.

Referring to FIG. 14, a shooting game system 900 may include a display device 910 and an airsoft gun 920, and the display device 910 may include a light transmitter according to the above embodiments. Also, although not shown in FIG. 7, the shooting game system 900 may further include a supply unit for supplying compressed gas and a pellet to the airsoft gun 920, along with a control board (not shown) for controlling an overall operation related to pellet firing of the airsoft gun 920.

In the shooting game system 900, the display device 910 and the airsoft gun 920 need to maintain a distance suitable for a shooting fame to fire a bullet, and information of the suitable distance may be stored in the control board. For example, the display device 910 needs to be located between a minimum distance d1 and a maximum distance d2 from the airsoft gun 920. When a distance detection sensor mounted in the airsoft gun 920 detects that a distance of the display device 910 is between the minimum distance d1 and the maximum distance, a pellet may be controlled to be fired from the airsoft gun 920.

According to an embodiment, speed information for adjusting a firing speed of a pellet according to a distance detection result between the display device 910 and the airsoft gun 920 may be further stored in the control board. When a distance of the display device 910 corresponds to the minimum distance d1, a firing speed of a pellet may be reduced by reducing the amount of compressed gas provided to the airsoft gun 920, and when a distance of the display device 910 corresponds to the maximum distance d2, a firing speed of a pellet may be increased by increasing the amount of compressed gas provided to the airsoft gun 920.

Alternatively, the control board may a control operation so that a pellet is fired at a constant speed when it is detected that a distance between the display device 910 and the airsoft gun 920 is located between the minimum distance d1 and the maximum distance d2, whereas a firing speed of a pellet is reduced when it is detected that a distance of the display device 910 is less than the minimum distance d1 or greater than the maximum distance d2. In addition, by considering an appropriate distance between the minimum distance d1 and the maximum distance d2, a pellet firing operation may be controlled in various other ways based on a distance detected by the distance detection sensor.

Figure 15A:
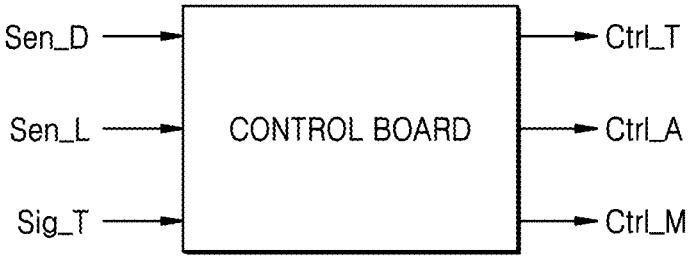

FIGS. 15A, 15B, and 15C are views illustrating a shooting game system which may be implemented according to other embodiments of the present disclosure.

As shown in FIG. 15A, a control board provided in a shooting game system may receive a distance detection result Sen_D, a direction detection result Sen_L, and a trigger firing signal Sig_T, and may also output a valve control signal Ctrl_A, a motor control signal Ctrl_M, and a firing sensing control signal Ctrl_T. Also, a pellet firing operation may be performed or blocked in various modes based on the distance detection result Sen_D and the direction detection result Sen_L according to the above embodiments, and a detailed operation thereof will be described as follows.

FIG. 15B is a diagram illustrating an operation before a shooting game system is driven. When a user requests the shooting game system to start a game, a certain initial setting operation may be performed, and in this case, the user may aim a muzzle of an airsoft gun at a target, and a distance detection sensor and a light detector mounted in the airsoft gun may be activated.

According to detection results, when a distance of the target is within a certain range and a light angle detected by the light detector satisfies a certain reference value, an air valve, a feeder, and a sensor unit for firing detection may all be activated. Accordingly, a normal shooting game may start, and a pellet may be normally fired in response to reception of the trigger firing signal Sig_T.

In contrast, when at least one of the distance of the target and the detected light angle in the initial setting operation is not within a certain range (or reference value), the air valve, the feeder, and the sensor unit for firing detection may all be inactivated. Accordingly, a shooting game may not start, and the detection operation may be performed again until the initial setting operation is normally completed.

FIG. 15C is a diagram illustrating an example of selecting a firing mode based on a distance of a target and a detected light angle after a shooting game starts.

In an operation, when a distance of a target is not within a certain range, it may be determined that an obstacle such as a person exists close to an airsoft gun, and thus, more safety needs to be ensured. Also, when a detected light angle is out of a reference value, it may be determined that an obstacle such as a person does not exist nearby but a direction of a muzzle is wrong. Also, when both the distance of the target and the light angle are out of the certain range and the reference value, it may be determined that the airsoft gun is not properly controlled by the user. When the distance of the target is not within the certain range of FIG. 8C, it is assumed that a person is located between the target and the airsoft gun and thus the distance is detected as short.

According to an operation, when the distance of the target is not within the certain range but the light angle corresponds to the reference value, a person may be located close to the airsoft gun, and in this case, even when firing is detected, a pellet may be controlled not to be fired by inactivating both the air valve and the feeder. Even when firing is detected, the air valve does not operate, and thus, compressed gas may not be provided to a main body. Accordingly, the pellet may not be fired, and an operation of releasing the compressed gas to the outside of the airsoft gun may be blocked.

When the distance of the target is within the certain range but the light angle is out of the reference value, it may be assumed that a person is located nearby but a direction of the muzzle is away from the target and is directed to another place. In this case, even when firing is detected, a pellet may be controlled not to be fired by activating the air valve and inactivating the feeder. Because the pellet is not provided to the main body, even when compressed gas is provided and released to the main body, the pellet may not be actually fired, and the user may identify that the muzzle is aimed outside the appropriate range by checking the release of the compressed gas.

When the distance of the target is not within the certain range and the light angle is out of the reference value, firing itself may not be detected by inactivating the sensor unit for performing firing detection. For example, because the air valve and the feeder are activated but firing itself is not detected, compressed gas and a pellet may not be provided to the main body. Accordingly, a situation where firing is detected when a pellet should not be fired and thus the pellet is wrongly fired may be prevented.

Figure 16:
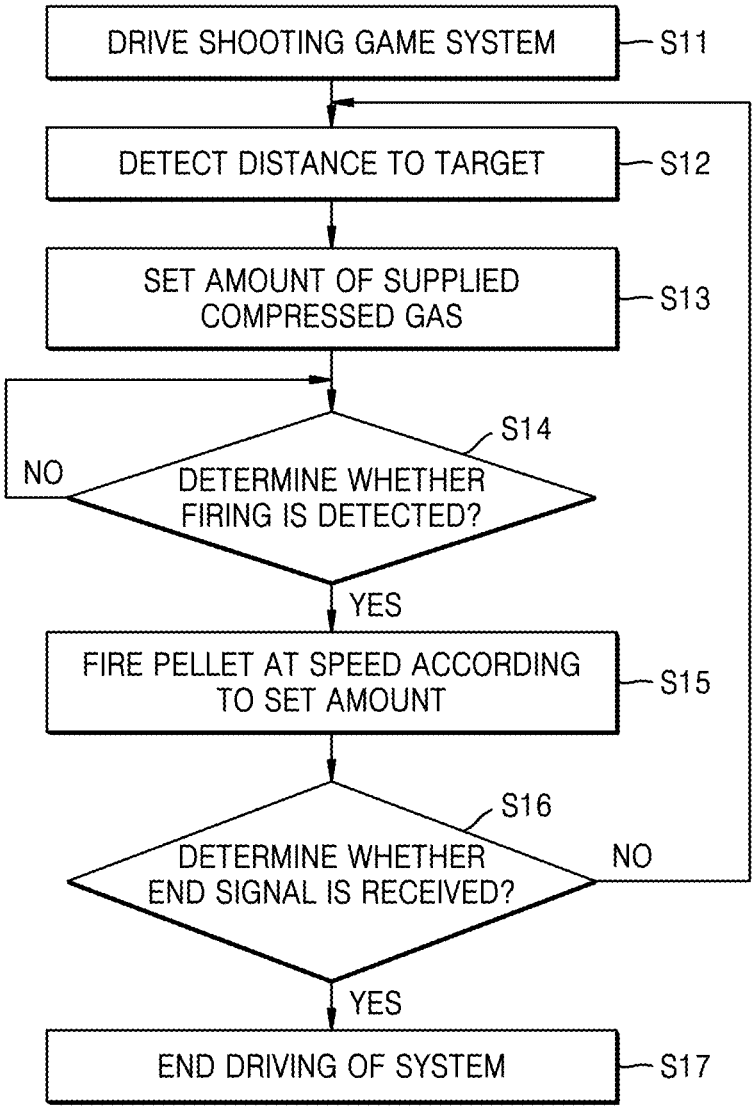
FIG. 16 is a flowchart illustrating a shooting game system which may be implemented according to other embodiments of the present disclosure.

FIG. 16 is a flowchart illustrating a shooting game system which may be implemented according to other embodiments of the present disclosure.

Referring to FIG. 16, a shooting game system begins to be driven according to a user's selection (S11), and a distance to a target (e.g., a display device) may be detected through a distance detection sensor mounted in an airsoft gun according to the above embodiments (S12). Also, the amount of supplied compressed gas may be set based on a detection result (S13), and information related to the set amount of supplied compressed gas may be stored in a control board.

Next, when the user pulls a trigger, firing may be detected by a sensor unit mounted in the airsoft gun (S14), and when the firing is detected, compressed gas may be supplied according to the set amount and a pellet may be accordingly fired at a pellet speed (S15). Next, it may be determined whether the driving of the shooting game system ends (S16), and when the driving does not end, a distance to the target may be detected continuously or periodically, and when the detected distance is close enough to be determined as an obstacle, pellet firing may be blocked according to the above embodiments. Also, the detected distance to the target is changed, the amount of supplied compressed gas may be changed based on the changed distance, and thus, the pellet speed may be changed. In a step of determining whether the driving of the shooting game system ends, when it is determined that the driving ends, the driving of the shooting game system may end (S17).

According to an embodiment of FIG. 16, the shooting game system according to embodiments of the present disclosure may provide an optimal game environment when shooting is performed between users offline such as in a survival game rather than shooting toward a display device. That is, in a survival game, a pellet should be fired at a speed sufficient to ensure safety for a user and recognize that a pellet has been sufficiently hit, and a distance to a target may be changed in real time in a game process. Accordingly, according to an embodiment of FIG. 9, an optimal game environment may be provided by adjusting the amount of supplied compressed gas based on a distance detection result, and when a target is located too close and a pellet should not be fired, the pellet may be prevented from being fired through control of a feeder, an air valve, and a sensor unit by applying a safe distance control method according to the above embodiments.

Figure 17:
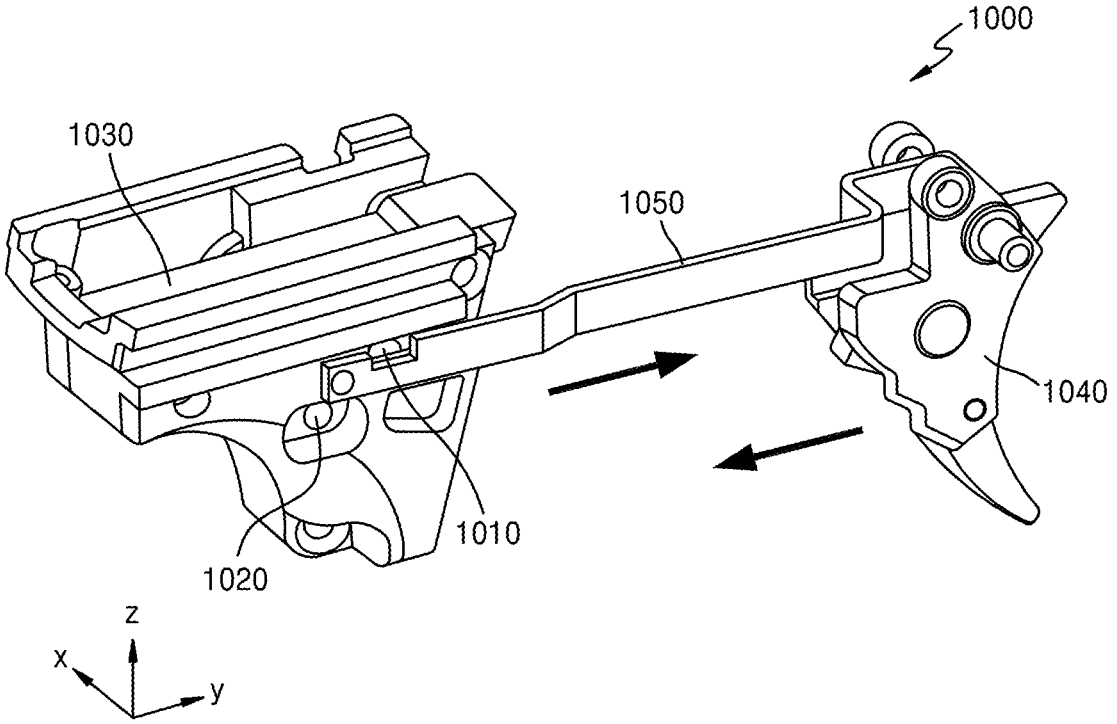
FIG. 17 is a view illustrating a structure of a trigger firing detection system, according to an embodiment of the present disclosure.

FIG. 17 is a view illustrating a structure of a trigger firing detection system, according to an embodiment of the present disclosure. In FIG. 17, a detailed description of elements which are the same as those described in the above embodiments will be omitted.

An airsoft gun 1000 may include a reed sensor 1010, a sensor mount 1030, a trigger 1040, and a trigger lever 1050. Also, an element which may be sensed by the reed sensor 1010 may be mounted on the trigger lever 1050. Although a magnet 1020 is mounted on the trigger lever 1050 in FIG. 17, an embodiment of the present disclosure is not limited thereto, and elements capable of detecting a movement of the trigger lever 1050 in various methods may be applied.

The reed sensor 1010 may be mounted in an inner space (or hole) formed in the sensor mount 1030, and in FIG. 17, the reed sensor 1010 may extend in a first direction x and may be mounted on the sensor mount 1030. Accordingly, the reed sensor 1010 may be exposed to the outside through a hole in an outer surface of the sensor mount 1030. Also, the magnet 1020 may be moved when the trigger lever 1050 is moved, and when the trigger 1040 is pulled, the magnet 1020 may be moved to a position at which the reed sensor 1010 is mounted and a change in a magnetic field may be provided to the reed sensor 1010. For example, the magnet 1020 may be moved in a second direction y in FIG. 17. Each of the first direction x and the second direction y may be perpendicular to a vertical direction (e.g., z direction). According to the above structure, when the trigger lever 1050 is moved, the magnet 1020 may be located close to the reed sensor 1010 that is exposed to the outside, and a large change in a magnetic field detected by the reed sensor 1010 may occur, thereby improving sensing sensitivity and improving the accuracy of a firing detection signal.

The present disclosure has been particularly shown and described with reference to exemplary embodiments thereof. While the present disclosure has been described by using specific terms, the terms have merely been used to explain the present disclosure and should not be construed as limiting the concept or scope of the present disclosure as defined by the claims. It will be understood by one of ordinary skill in the art that various modifications and equivalent other embodiments may be made therein. Accordingly, the true technical scope of the present disclosure is defined by the technical spirit of the appended claims.

INDUSTRIAL APPLICABILITY

The present disclosure may be industrially applied to various types of games and game tools.

The invention claimed is:

1. A shooting game system using an airsoft gun from which pellets are fired, the shooting game system comprising:

a main body comprising a muzzle through which a pellet moves, a light-emitting device being mounted in the main body and configured to provide light to the pellet so that the pellet is changed to a fluorescent color in a light-emitting region in the muzzle;

a sensor unit configured to detect pulling of a trigger provided on the main body and provide a firing detection signal;

a supply unit configured to supply the pellet and compressed gas to the main body; and a control board configured to control the supply unit to provide the pellet and the compressed gas to the main body in response to the firing detection signal, wherein the control board comprises an auto tracer controller configured to control the light-emitting device to emit light at a timing when the pellet passes through the light-emitting region in response to the firing detection signal.

2. The shooting game system of claim 1, wherein the control board is further configured to control the light-emitting device to emit light at a timing of controlling the supply unit or when a certain time elapses after controlling the supply unit.

3. The shooting game system of claim 1 wherein the control board is further configured to control the light-emitting device to begin to emit light at a timing after the pellet moves in the muzzle and enters the light-emitting region and before the pellet is fired out of the muzzle of the main body.

4. The shooting game system of claim 1, wherein the supply unit comprises:

a magazine comprising a pellet moving portion through which the pellet moves and a gas moving portion through which the compressed gas moves;

a feeder separated from the magazine unit, connected to the magazine unit through a pellet connecting portion, and configured to provide the pellet; and a gas tank separated from the magazine unit, connected to the magazine unit through a gas connecting portion, and configured to provide the compressed gas to the magazine unit when an air valve controlled by the control board is opened.

5. The shooting game system of claim 4, wherein the control board is further configured to control a light emission timing of the light-emitting device in association with a timing of controlling opening of the air valve in response to the firing detection signal.

6. The shooting game system of claim 4, wherein an operation of setting an amount of the compressed gas provided in response to the firing detection signal is configured to be previously performed, and the control board is further configured to differently control a light emission timing of the light-emitting device according to the set amount of the compressed gas.

7. The shooting game system of claim 1, wherein the pellet is coated with a material whose color is changed to a fluorescent color by receiving light from the light-emitting device.

8. A shooting game system using an airsoft gun from which pellets are fired, the shooting game system comprising:

a main body comprising a muzzle through which a pellet moves, a distance detection sensor configured to detect a distance to a target being mounted on a side of the main body;

a sensor unit configured to detect pulling of a trigger provided on the main body and provide a firing detection signal;

a supply unit configured to supply the pellet and compressed gas to the main body; and a control board configured to control the supply unit to provide the pellet and the compressed gas to the main body in response to the firing detection signal, wherein the control board comprises a firing controller configured to block firing of the pellet by controlling at least one of the sensor unit and the supply unit when the distance detected from the distance detection sensor is out of a certain set range.

9. The shooting game system of claim 8, wherein the control board is further configured to block the firing of the pellet by controlling pulling of the trigger not to be detected by inactivating the sensor unit.

10. The shooting game system of claim 8, wherein the supply unit comprises:

a magazine unit comprising a pellet moving portion through which the pellet moves and a gas moving portion through which the compressed gas moves;

a feeder separated from the magazine unit, connected to the magazine unit through a pellet connecting portion, and configured to provide the pellet; and a gas tank separated from the magazine unit, connected to the magazine unit through a gas connecting portion, and configured to provide the compressed gas to the magazine unit according to opening of an air valve controlled by the control board, wherein the control board is further configured to block the firing of the pellet by controlling at least one of the pellet and the compressed gas not to be provided to the magazine unit.

11. The shooting game system of claim 10, wherein the control board is further configured to change a firing speed of the pellet by controlling opening of the air valve according to the detected distance, when the distance detected from the distance detection sensor is not out of the certain set range.

12. The shooting game system of claim 8, further comprising a light detector configured to detect an incidence angle of light emitted from the target, wherein the control board is further configured to block the firing of the pellet based on a detection result from the light detector and the distance detected from the distance detection sensor.

13. The shooting game system of claim 12, wherein the control board is further configured to control the pellet to be fired when the distance detected from the distance detection sensor is not out of the certain set range and the incidence angle of the light satisfies a certain reference value.

14. The shooting game system of claim 8, wherein the control board is further configured to:

calculate the certain set range in which the pellet is fired based on a result of detecting the distance to the target in an initial setting process of a shooting game, and determine whether the distance detected from the distance detection sensor is out of the certain set range calculated in the initial setting process in a course of the shooting game.

* * * * *